US011807435B2

(12) United States Patent
Sabin et al.

(10) Patent No.: US 11,807,435 B2
(45) Date of Patent: Nov. 7, 2023

(54) SECURE HOLDER FOR COLLECTIBLES

(71) Applicant: Collectors Universe, Inc., Santa Ana, CA (US)

(72) Inventors: Stephanie Sabin, Tustin, CA (US); Michael Oveido, Shanghai (CN)

(73) Assignee: Collectors Universe, Inc., Santa Ana, CA (US)

( * ) Notice: Subject to any disclaimer, the term of this patent is extended or adjusted under 35 U.S.C. 154(b) by 0 days.

(21) Appl. No.: 17/522,895

(22) Filed: Nov. 9, 2021

(65) Prior Publication Data

US 2022/0144508 A1 May 12, 2022

Related U.S. Application Data

(60) Provisional application No. 63/111,506, filed on Nov. 9, 2020.

(51) Int. Cl.

| | |
|---|---|
| ***B65D 55/02*** | (2006.01) |
| ***A47G 1/12*** | (2006.01) |
| ***B65D 77/20*** | (2006.01) |

(52) U.S. Cl.

CPC ..... *B65D 55/02* (2013.01); *A47G 1/12* (2013.01); *B65D 77/2004* (2013.01)

(58) Field of Classification Search

CPC .... B65D 55/02; B65D 77/20; B65D 77/2004; A47G 1/12

See application file for complete search history.

(56) References Cited

U.S. PATENT DOCUMENTS

| | | | | |
|---|---|---|---|---|
| 4,915,214 A * | 4/1990 | Wieder | A47G 1/12 206/0.82 |
| 5,040,671 A * | 8/1991 | Hager | A45C 11/18 206/39 |
| 6,029,807 A * | 2/2000 | Love | B65D 85/48 206/0.82 |
| 7,458,178 B2 * | 12/2008 | Paschall | G09F 3/20 40/661 |
| 8,376,133 B2 * | 2/2013 | Macor | B65D 85/58 206/0.8 |

OTHER PUBLICATIONS

International Search Report and Written Opinion on corresponding PCT application (PCT/US2022/024467) from International Searching Authority (EPO) dated Jul. 7, 2022.

* cited by examiner

*Primary Examiner* — Javier A Pagan
(74) *Attorney, Agent, or Firm* — KOS IP Law LLP

(57) ABSTRACT

A holder for storing a collectible, such as a stack of banknotes, having a first housing assembled with a second housing and defining an enclosed space therein. A collectible receiving structure is disposed within the enclosed space and spaced from an outer perimeter wall. A locking structure disposed within the enclosed space, the locking structure having a first locking member formed with the first housing and a second locking member formed with the second housing and configured so that before the first housing is assembled with the second housing the first locking member is movable relative to the second locking member.

33 Claims, 20 Drawing Sheets

SECURE HOLDER FOR COLLECTIBLES

CROSS-REFERENCE TO RELATED APPLICATIONS

The application claims the benefit of U.S. Provisional Application No. 63/111,506, which was filed Nov. 9, 2020, the entirety of which is hereby incorporated by reference.

BACKGROUND

The present disclosure relates to holders for collectible items, and more particularly to such holders that offer security and resistance to counterfeiting.

A substantial market exists for collectibles. Establishing the value of such items can involve several factors, including the rarity and condition of the item. In order to establish a value so as to facilitate commercial transfer of collectibles, standards have been developed for grading aspects of particular collectible items. For example, a particular coin can be graded with regards to its strike, luster, date or the like. Paper-based collectibles such as currency and sports cards can also be graded in connection with features such as condition, color, defects, centering and the like. Organizations exist for grading collectibles. For example, Professional Sports Authenticators (PSA) evaluates and grades sports cards, and Professional Coin Grading Service (PCGS) evaluates and grades coins.

In order to store such collectibles and protect them from damage, it is known to encapsulate them within holders that can be closed around the collectible, both protecting and enabling display of the item. Such holders can also include data concerning the collectible, such as grades, descriptions and identity.

Some collectibles command substantial prices in the market. There is thus a risk that counterfeiters will attempt to pass off a counterfeit item. As such, organizations that grade collectibles often will also identify and authenticate such collectibles. The collectible holders can also include indicia of the authenticity and grading of the associated collectible. Further, collectible holders can be sealed so as to prevent the enclosed collectible item from being replaced with a counterfeit. For example, it is known to ultrasonically weld opposing portions of a holder together with the collectible enclosed inside. Such a permanent seal is intended to prevent the holder from being opened, and thus stop the enclosed collectible from being replaced with a counterfeit.

Risks of counterfeiting, however, remain. For example, there is a risk that a counterfeiter may carefully defeat the ultrasonic weld, and thus be able to open the holder, remove the original collectible and replace it with a counterfeit, and then re-weld the holder closed.

SUMMARY

The present disclosure describes embodiments of improved collectible holders that cannot be opened without destroying the holder, thus preventing a holder bearing indicia of authenticity and grading from being used with a counterfeit collectible. The discussion also includes embodiments of collectible holders having improved qualities of protecting collectible items stored therein. Further the present disclosure also includes embodiments having improved properties in connection with managing information concerning collectibles and in disseminating such information.

In accordance with one embodiment, the present disclosure discusses a holder for storing a collectible, comprising a first housing having a first wall; a second housing having a second wall; the first housing and the second housing being configured so that the first housing can be assembled with the second housing, and an enclosed space is defined within the assembled first and second housings, the enclosed space defined between the first wall, the second wall, and an outer wall extending between the first wall and the second wall; a collectible receiving structure disposed within the enclosed space and spaced from the outer wall, the collectible receiving structure defining a collectible receiving space sized and configured to retain the collectible therewithin; and a locking structure disposed within the enclosed space, the locking structure comprising a first locking member formed with the first housing and a second locking member formed with the second housing. The locking structure is configured so that before the first housing is assembled with the second housing the first locking member is movable relative to the second locking member, and when the first housing becomes fully assembled with the second housing the locking structure moves to a triggered configuration in which the first locking member and the second locking member are engaged with one another. When the locking structure is in the triggered configuration, the first housing is blocked from being disassembled from the second housing.

In an additional embodiment, the outer wall extends from the first wall of the first housing, and a lock wall extends from the second wall of the second housing, and the second locking member is disposed on the lock wall. In a yet further embodiment, the first and second housings are assembled, access to the locking structure from outside the holder is blocked by one or more of the first wall, second wall and outer wall. In a still further embodiment, the first locking member is formed on an inner surface of the outer wall. In still another embodiment, one of the first and second locking members comprises a catch, and the other of the first and second locking members comprises a slot configured to receive the catch. In some such embodiments, the catch and the slot are both elongated. Additional embodiments can comprise a plurality of spaced-apart catches and corresponding spaced apart grooves.

In another embodiment, the lock wall is spaced from an outer edge of the second wall, and a second wall edge surface is defined between the lock wall and the second wall outer edge, and wherein when the first and second housings are assembled, an outer wall tip engages the second wall edge surface. In some such embodiments, an elongated groove is formed in the second wall outer edge, and an elongated tongue extends from the outer wall tip, the tongue and groove sized and located so that the tongue is received within the groove when the first and second housings are assembled. In additional embodiments, the groove has a key structure formed therewithin, and the tongue has a key cavity shaped to complement the key structure so that the tongue registers with the groove.

In a further embodiment, a first portion of the lock wall is more resistant to flexing about a base of the lock wall than is a second portion of the lock wall.

In yet another embodiment, the collectible receiving space is shaped so as to have a plurality of corners, wherein the collectible receiving structure comprises a plurality of receiver walls extending from a base to a tip, the base connected to one of the first wall and second wall, each of the plurality of receiver walls being elongated from a first end to a second end, and wherein a first one of the plurality of receiver walls is positioned so that it first end is spaced from a first corner of the collectible receiving space and its second end is spaced from a second corner of the collectible receiving space. Some such embodiments can additionally comprise a raised platform extending from one of the first wall and second wall, wherein the raised platform has an outer edge, and wherein the raised platform is sized and positioned so that when the first and second housings are assembled, the raised platform is within the collectible receiving space and the outer edge is spaced from adjacent ones of the plurality of receiver walls.

In yet other embodiments, a channel can be formed in one of the first wall and second wall, and wherein the channel is sized and configured so that when the first and second housings are assembled the channel is aligned with the plurality of receiver walls attached to the other of the first wall and second wall, and wherein the receiver walls are sized so that, when the first and second housings are assembled, the tips of the receiver walls extend into the channel.

In still another embodiment, the collectible receiving structure disposed within the enclosed space is sized and shaped to accommodate a stack of banknotes. In some such embodiments, the collectible receiving space has two sets of two parallel receiver walls that are sized and shaped to accommodate the stack of banknotes. In further embodiments, the two sets of two parallel receiver walls can define a generally rectangular shaped region, and wherein four corners of the generally rectangular shaped region are spaced from four corners of the stack of banknotes.

In accordance with another embodiment, the present specification discloses a method of securing a collectible, comprising: placing the collectible in a collectible receiving space defined by one or more receiver walls of a first housing, the first housing having a first wall, the one or more receiver walls extending from the first wall; placing a label indicia in a label space defined in the first housing and spaced from the collectible receiving space; and assembling the first housing with a second housing to form a collectible holder, comprising advancing the second housing over the first housing until a first locking structure on the first housing engages a second locking structure on the second housing. When the first locking structure is engaged with the second structure the first housing is prevented from being removed from the second housing.

In another embodiment the first locking structure is spaced outwardly from the collectible receiving space. In a further embodiment, the first wall, the second wall, and an outer wall extending between the first wall and second wall block access to the engaged first and second locking structures from outside the collectible holder. Some such embodiments can additionally comprise advancing a tongue of the outer wall into a groove formed in one of the first wall and second wall while assembling the first housing with the second housing. Further embodiments can comprise ultrasonically welding at least portion of the tongue to corresponding portions of the groove.

DESCRIPTION

Figure 2:
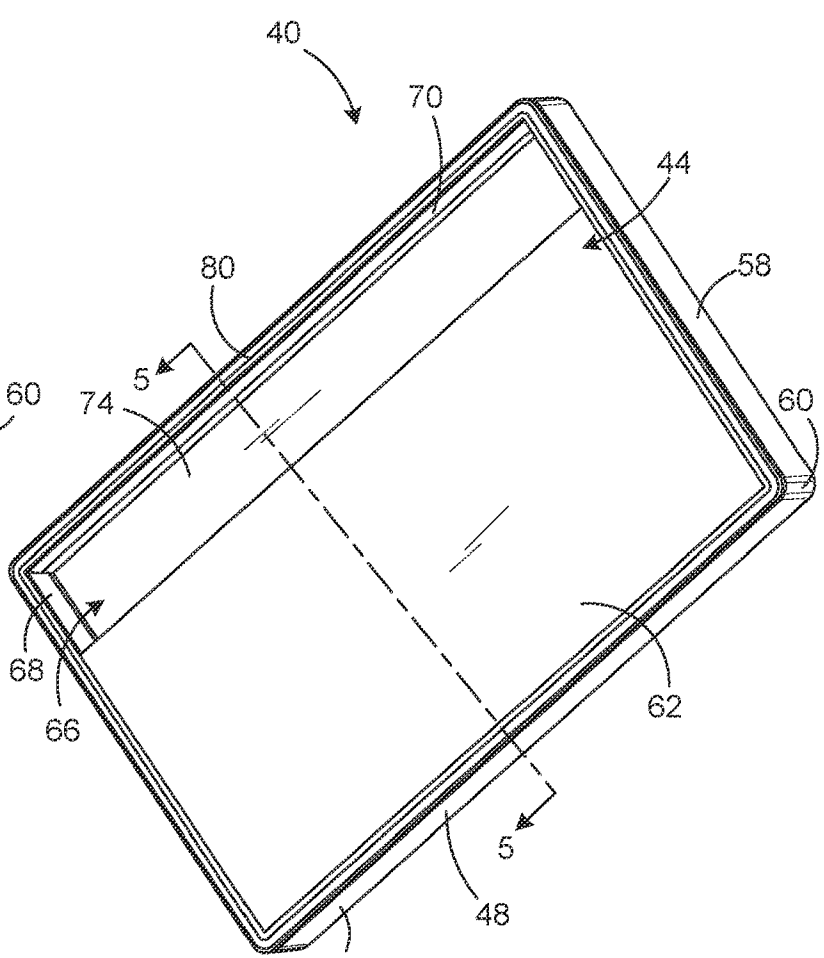
FIG. 2 is a back perspective view of the collectible holder of FIG. 1.
Figure 1:
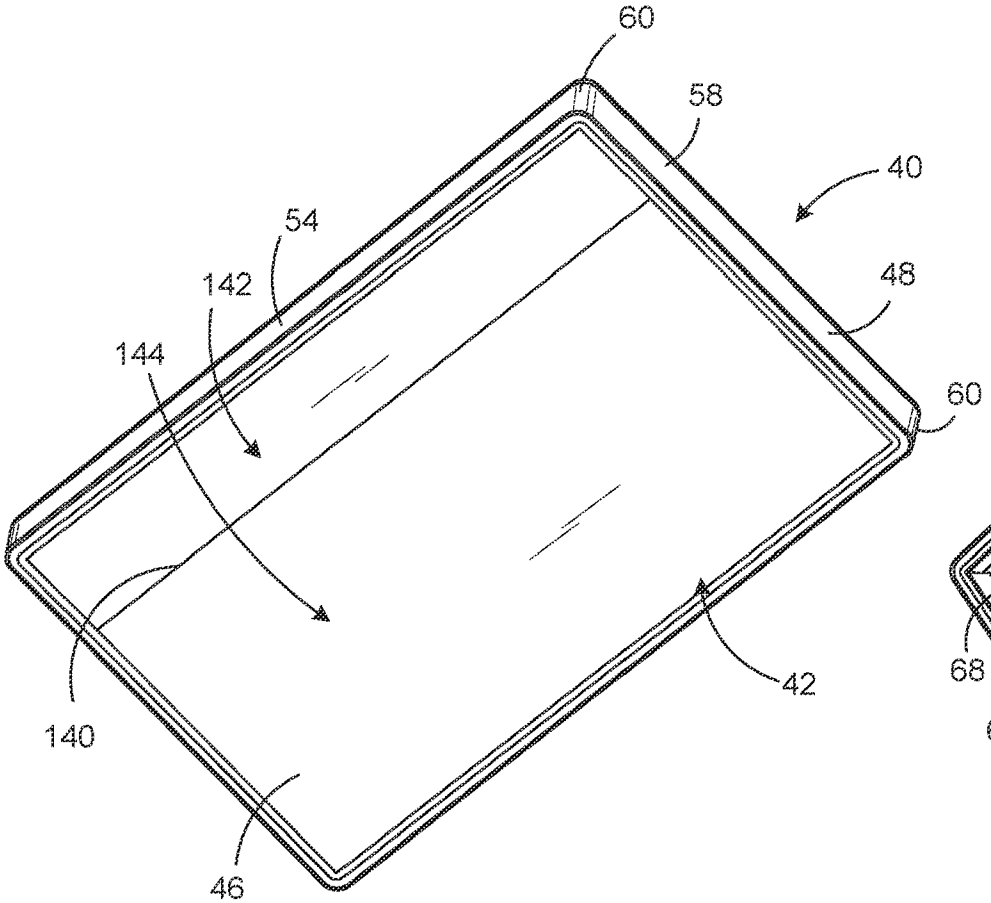
FIG. 1 is a front perspective view of a collectible holder having aspects in accordance with one embodiment.
Figure 3:
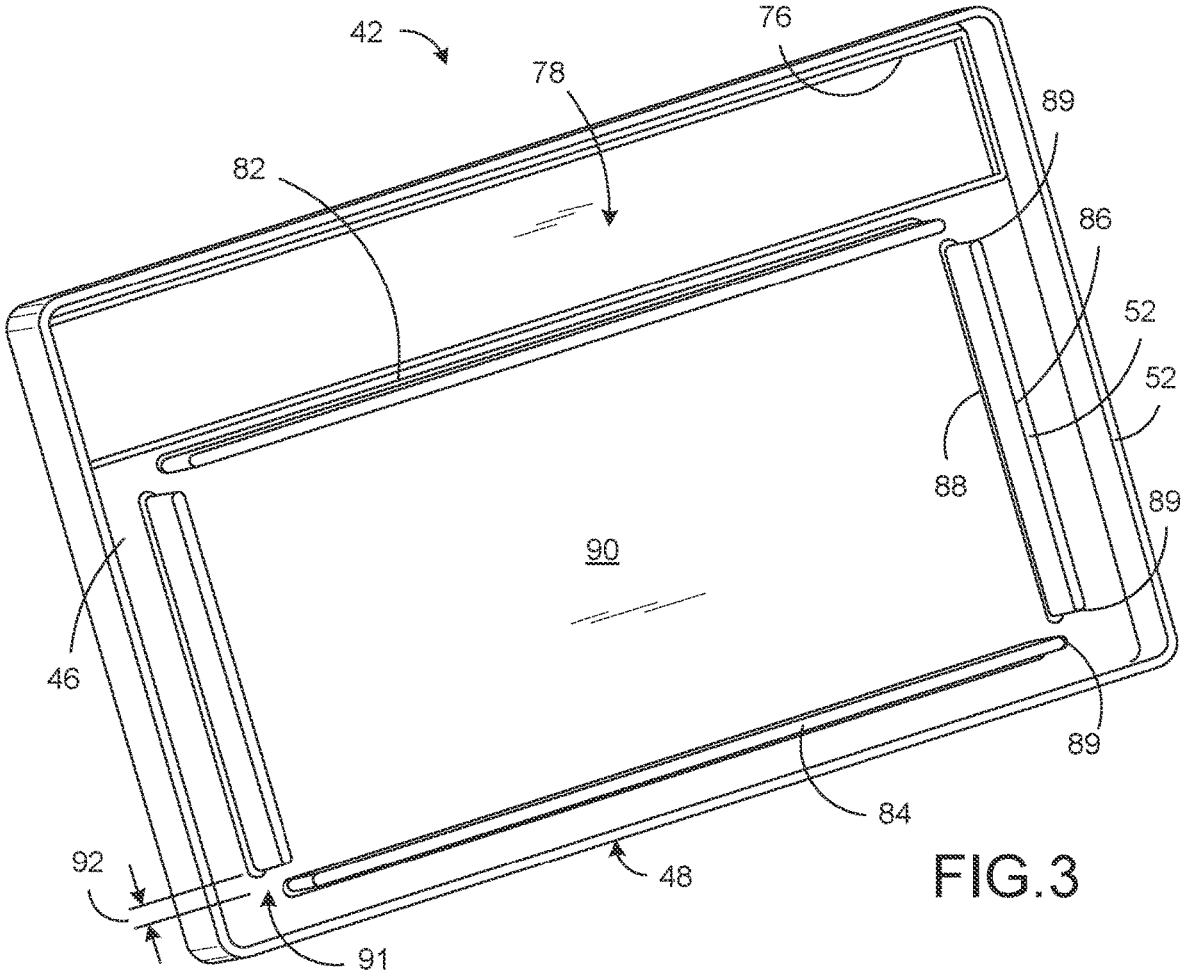
FIG. 3 is a perspective view of a front housing of the collectible holder of FIG. 1.
Figure 4:
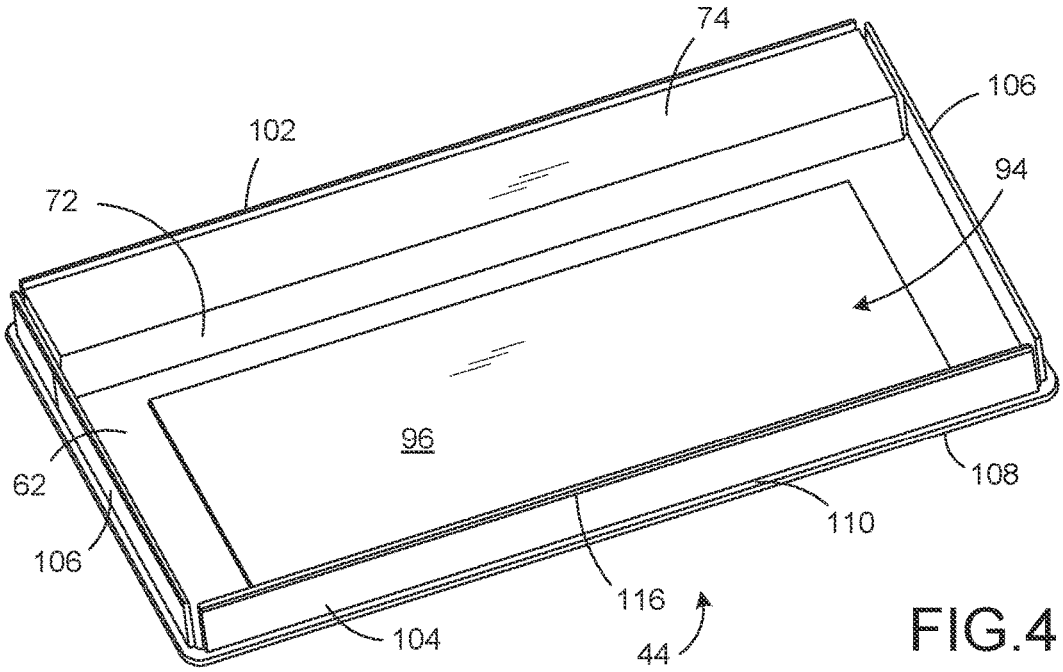
FIG. 4 is a perspective view of a back housing of the collectible holder of FIG. 1.

Initial reference is made to FIGS. 1 and 2, which illustrate front and back perspective views of one embodiment of a collectible holder 40 formed by assembling a front housing 42 as shown in FIG. 3 with a back housing 44 as shown in FIG. 4.

In the illustrated embodiment, the front housing 43 comprises a front wall 46. An outer wall 48 extends generally normally from the front wall 46 about an entire circumferential edge of the front wall 46. In the illustrated embodiment the outer wall 48 is substantially contiguous about the circumference of the front wall 46. The outer wall 48 extends from the front wall 46 and terminates at a tip 52. Preferably the outer wall 48 is flat along its entire tip 52. In the illustrated embodiment, the outer wall 48 is comprised of opposing top and bottom elongated side portions 54, 56 and opposing elongated end portions 58. The side portions 54, 56 and adjacent end portions 58 are connected at corners 60. In the illustrated embodiment, the side and end portions that together make up the outer wall 48 are contiguous, and a height of the outer wall 48 taken between the front wall 46 and the tip 52 is uniform about the entire outer wall 48.

With additional reference to FIGS. 5-8, the back housing comprises 44 a back wall 62 that abuts the tip 52 of the outer wall 48 when the front and back housings 42, 44 are assembled. As such, when assembled to form the collectible holder 40, an enclosed space 64 is defined within the front wall 46, back wall 62, and outer wall 48. A trough 66 is defined by opposing trough end walls 68 and opposing trough top and bottom side walls 70, 72 that extend from the back wall 62. A label wall 74 extends across and connects the trough side and end walls 70, 72, 68.

In the illustrated embodiment, a frame wall 76 extends from an inner surface of the front wall 46 of the front housing 42. The frame wall 76 is made up of opposing side and end wall portions 54, 56, 58 that are attached to one another at corners 60. A label space 78 is defined by the frame wall 76 and the front wall 46. In the illustrated embodiment, the frame wall 76 extends only a short distance from the front wall 46, and is disposed adjacent a top side wall portion 54. Preferably, the frame wall 76 is sized and configured to generally complement the configuration of the trough side and end walls 60, 70, 72 so that the label wall 76 of the trough 66 is received into the label space 78. When assembled, preferably the label space 78 between the front wall 46 and label wall 76 is quite small, such as being configured to accommodate the width of only one or two sheets of paper.

In the illustrated embodiment, the trough 66 is disposed immediately adjacent the top portion 54 of the outer wall 48 when the housings 42, 44 are assembled, as shown in FIG. 2. Preferably, the trough top side wall 70 and the top portion 54 of the outer wall 48 collectively define a handle 80 by which a user can easily carry the holder 40.

With particular reference next to FIGS. 3-8, a top receiver side wall 82 extends from the front wall 46 and is spaced from the label space 78. A bottom receiver side wall 84 also extends from the front wall 46 and is spaced from the opposing top receiver side wall 82. Opposing, spaced-apart receiver end walls 86 also extend from the front wall 46. Each of the receiver walls 82, 84, 86 is connected to the front wall 46 at a base 88 and terminates at a tip 52. Preferably, the receiver walls 82, 84, 86 are co-formed with the front wall 46. The illustrated receiver walls are elongated and straight, extending between opposing ends 89. In the illustrated embodiment, the receiver side walls 82, 84 are elongated in an end-to-end direction and the receiver end walls 86 are elongated in a top-to-bottom direction. A receiver space 90 is defined within the receiver side and end walls 82, 84, 86.

In the illustrated embodiment, the ends 89 of the receiver side and end walls 82, 84, 86 do not connect with one another. More specifically, adjacent ends 89 are spaced from one another so as to define an open corner 91 where adjacent walls terminate before intersecting. A corner space 93 can be defined as the distance between the end 89 of one of the receiver walls and the location of the adjacent receiver wall.

The receiver space 90 is defined by the receiver side and end walls 82, 84, 86 and an inner surface of the front wall 46. Preferably the inner surface is substantially flat. In the illustrated embodiment, the receiver space 90 is located generally below the label space 78. As such, a center of the receiver space 90 is offset downwardly from a center of the holder 40, and a center of the label space 78 is offset upwardly from the center of the holder 40.

A platform 94 extends from the back wall 62 of the back housing 44 and terminates in a platform surface 96. As such, the platform surface 96 is spaced a platform height 97 from a back wall 62 inner surface. Preferably, the platform 94 is dimensioned so as to fit between the receiver walls 82, 84, 86 that define the receiver space 90, with a platform space 99 defined between an edge wall 100 of the platform 94 and the adjacent receiver wall 82, 84, 86 when the housings 42, 44 are assembled. As such, when the front and back housings 42, 44 are assembled, the tips 50 of the receiver walls 82, 84, 86 are closer to the back wall 62 inner surface than is the platform surface 96. In a preferred embodiment the tips 53 of the receiver walls 82, 84, 86 engage the back wall 62 inner surface when the housings 42, 44 are assembled.

With continued reference to FIGS. 3-8, a plurality of lock walls extend from the back wall 62 of the back housing 44. Specifically, in the illustrated embodiment, a top side locking wall 102 extends from the back wall 63 immediately adjacent—yet spaced outwardly from—the top side trough wall 70. A bottom side lock wall 104 is disposed adjacent the opposite edge of the back wall 62. Opposing end lock walls 106 extend from the back wall 62 adjacent opposite ends of the back wall 62 and between the top and bottom side lock walls 102, 104. Each of the lock walls 102, 104, 106 is spaced inwardly a short distance from the edge 108 of the back wall, and a back wall edge surface 110 is defined between each lock wall 102, 104, 106 and the adjacent edge 108 about the circumference of the back wall 62. In a preferred embodiment, the width of the back wall edge surface 110 is about the same as the thickness of the outer wall 48 of the front housing 42. As such, and as shown in FIGS. 1, 2, and 5-8, when the front and back housings 42, 44 are assembled with one another, the tip 50 of the outer wall 48 engages the back wall edge surface 110, preferably about the entire circumferences of the front wall 46 and the back wall 62.

Each of the lock walls 102, 104, 106 in the illustrated embodiment is substantially elongated and terminates at opposing wall ends 112. In the illustrated embodiment, the ends 112 of the side lock walls 102, 104 are spaced from and not connected to the ends 112 of the end lock walls 106.

Continuing with reference to FIGS. 3-8, a lock structure 114 is provided to lock the front and back housings 42, 44 into engagement with one another so as to resist disassembly of the housings once they are assembled. In the illustrated embodiment, each lock wall 102, 104, 106 includes a catch 116 extending outwardly therefrom. A slide surface 118 extends from the catch 116 toward the tip 52 of the corresponding lock wall. Preferably, the slide surface 118 is tapered moving from the catch 116 toward the tip 52. A plurality of lock receivers 120 are defined inside of the front housing outer wall 48. In the illustrated embodiment, the lock receivers 120 each are elongated slots running along the inner surface of the outer wall 48 so as to be aligned with the catches 116 when the front and back housings 42, 44 are assembled. As such, when the front housing 42 is being advanced over the back housing 44, the tapered slide surface 118 will engage the inner surface of the outer wall 48 and one or both of the lock wall 102, 104, 106 and outer wall 48 will deflect as advancement continues. Once the catch 116 reaches the lock receiver 120, however, such deflection will cease, and the catch 116 will snap into the lock receiver 120. With the catch 116 received in the lock receiver 120, the lock structure 114 has been triggered, and the front and back housings 42, 44 are fully assembled, or engaged, with one another.

In the illustrated embodiment, the catch 116 extends along the entire length of each of the lock walls 102, 104, 106, and the corresponding lock receiver 120 slot is formed in the outer wall 48, extending along substantially the entire length of the wall, but terminating before each corner 60, so that no slot 120 is formed rounding the corner 60. As such, the lock structure 114 is engaged along each of the top and bottom sides and both opposing ends of the engaged first and second housings 42, 44. In order to separate the front and back housing, a user would have to disengage the catches 116 that have been received in all of the lock receivers 120. However, access to the catches 116 is blocked by at least the outer wall 48, and also by the engaged outer wall tip 52 and back wall edge surface 110. As such, in order to disengage the locking structure 114, and thus disengage the front and back housings 42, 44 from one another, one would most likely have to damage the housings. Thus, once engaged, the front and back housings 42, 44 define a secure collectible holder 40 in which it is very difficult, if not impossible, to access the collectible stored within without destroying the holder 40 itself.

Figure 3A:
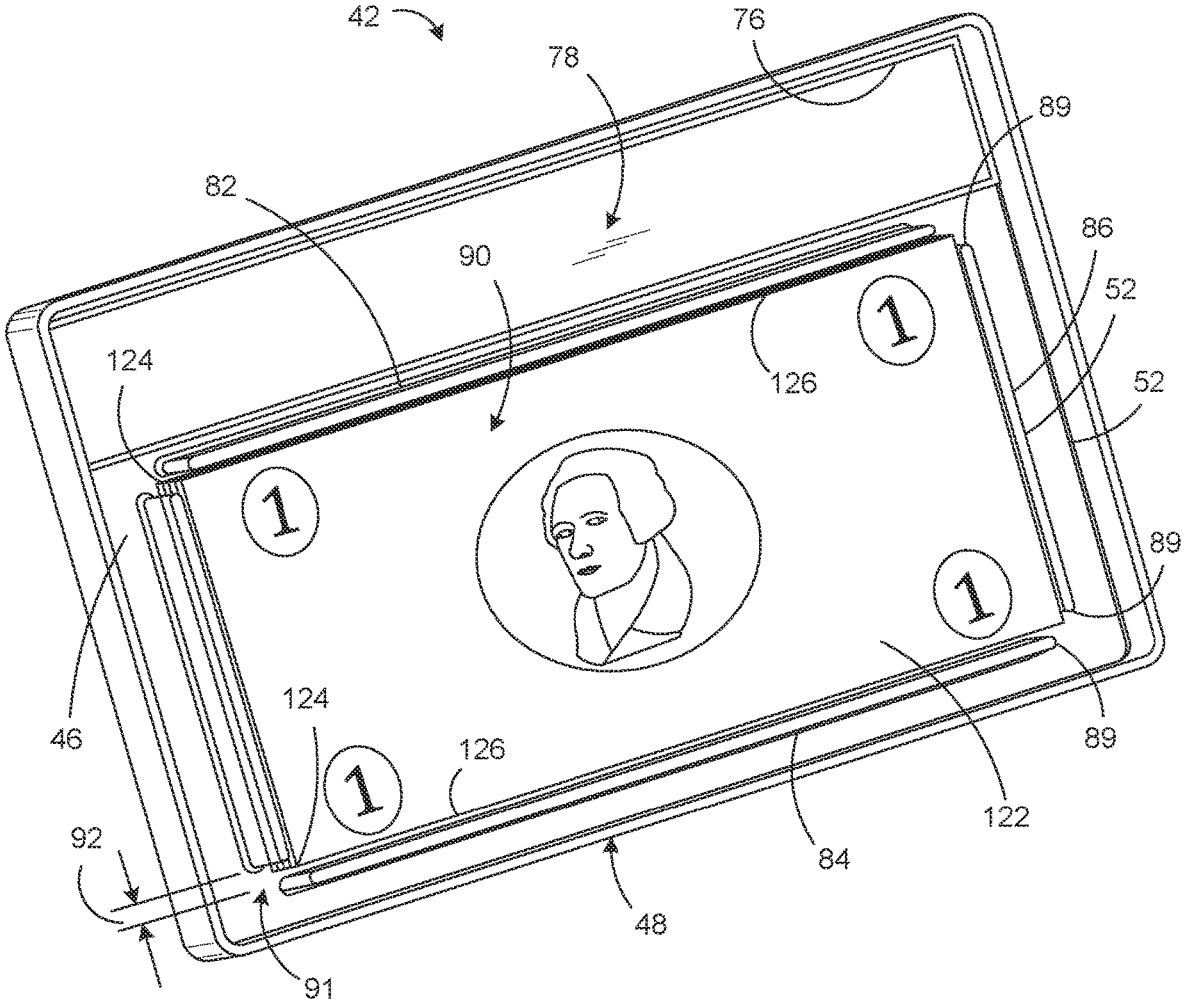
FIG. 3A shows the front housing of FIG. 3 with a stack of printed currency disposed therewithin.

With particular reference next to FIG. 3A, to use the holder 40, a user places the collectible item, such as a stack of freshly printed currency 122, within the receiver space 90. The corners 124 of the currency 122 are aligned with the open corners 91 of the receiver walls 82, 84, 86, and thus the corners 124 of the bills 122 do not engage any wall that could fold or otherwise damage them. Also, the bottommost bill 122 lies upon the platform 94 so the edges of that bill 122 are spaced from the tips 52 of the receiver walls 82, 84, 86. There is substantially no risk of the edges 126 of the bills 122 extending into or being caught between the receiver wall tips 52 and the inner surface of the back wall 62. Printed currency 122 may also be referred to as banknote 122 or paper money.

Continuing with reference to FIGS. 3-8, in the illustrated embodiment each of the lock walls 102, 104, 106 extends substantially contiguously along the entire side or end of the back housing 44. In other embodiments one or more of the lock walls could be discontiguous along its length, so that the respective side or end lock wall is actually made up of two or more lock walls lined up end to end.

In the illustrated embodiment, the lock walls 102, 104, 106 extend such that their tips 52 are immediately adjacent the housing front wall 46 when the front and back housings 42, 44 are assembled. Similarly, the slot 120 in the inner surface of the outer wall 48, which makes up the lock receiver 120, is immediately adjacent the front wall 46. As such, the locking structure 114 is spaced from the tip 52 of the outer wall 48, helping to block access to such locking structure 114 from outside the assembled collectible holder 40. Preferably, the locking structure 114 is positioned to be spaced from the outer wall tip 52 so as to block such access. However, it is to be understood that, in additional embodiments, the catch 116 of the lock wall 102, 104, 106, and the lock receiver 120, do not necessarily have to be adjacent the front wall 46, but can be spaced from both the front wall 46 and the outer wall 48 tip 52. In still further embodiments the height of the lock walls between the back wall 62 and the catch 116 can vary along the length of the lock walls 102, 104, 106—and similarly the distance of the lock receiver 120 from the outer wall 48 tip 52 can vary complementarily.

In still further embodiments the locking structure 114 can include additional variations in structure. For example, during at least portions of its length one or more of the lock walls 102, 104, 106 can have two or more catches 116 spaced apart from one another between the base of the lock wall 102, 104, 106 and its tip. And, of course, corresponding lock receivers 120 can be placed in the inner surface of the outer wall 48. Still further embodiments may employ—in addition or instead—lock walls extending from one of the front or back housings 42, 44 and spaced from the outer wall 48, and corresponding lock walls 102, 104, 106 extending from the opposite housing, and a locking structure 120 is provided so that the opposing lock walls physically lock with one another when the front and back housings 42, 44 are assembled. Preferably such locking structure is blocked by one or more of the outer wall 48, front wall 46 and back wall 62 from being accessed from outside the assembled collectible holder 40.

Figure 3B:
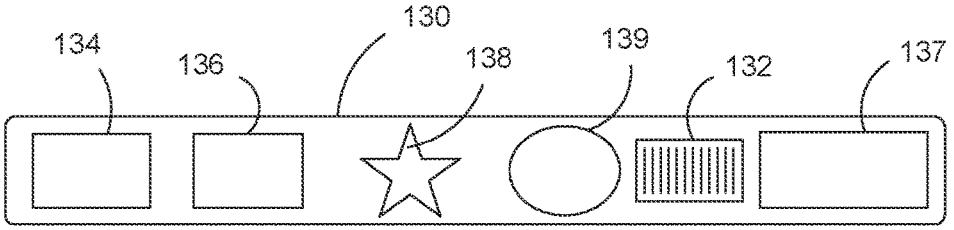
FIG. 3B shows a label adapted for use in the collectible holder of FIG. 1.

With specific reference to FIG. 3B, a label 130 bearing indicia of authentication, identification, and/or grading can be placed within the label space 78. The label 130 can include such information and devices such as, for example, a barcode 132 configured to link or refer a user to information about the identity, grade, etc. of the collectible held within the receiver space 90. In some embodiments, an RFID chip 134 and/or near-field-communication (NFC) enabled tag 136 can be included in the label space 78, and sometimes incorporated onto the label 130. Such structures can be programmed with information concerning the corresponding collectible and/or can direct a user to an online repository of such information. A written indicia 137 identifying or describing the contents can also be included.

Various security features can also be included. For example, the label 130 and/or label space 78 can include a hologram 138 and/or seal 139 or other indicia of a grading organization that has verified the authenticity and grade of the corresponding collectible. Additional security features can also be included. For example one or more label portions can be adhered to one or both of the front housing front wall 46 and back housing label wall 74 in a manner such that if the front and back housings 42, 44 are disassembled (likely from destructive actions), separation of the label 130 from either of the front wall 46 or label wall 74, or any attempt to remove such label 130 from one or both such surfaces, will result in the destruction of the label 130. As such, a counterfeiter that has destroyed an assembled holder 40 to gain access to the collectible held therewithin cannot transfer verification indicia from the holder 40 to another, undamaged holder 40, as the verification indicia will be destroyed in the attempt to remove it from the original holder. Counterfeiting efforts can thus be frustrated, as verification indicia cannot be removed from a holder 40 without being destroyed, and an assembled holder 40 cannot be opened to removed and replace the enclosed collectible without being destroyed. Thus, the collectible and associated verification indicia cannot be moved to a new holder 40.

Figure 5:
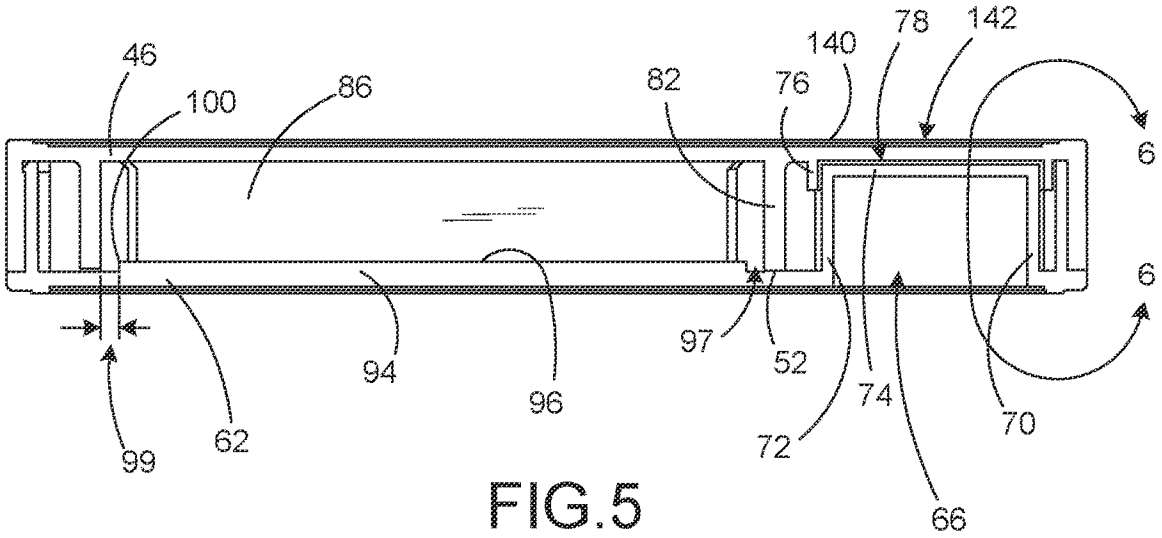
FIG. 5 is a cross-sectional view taken along line 5-5 of FIG. 2.
Figure 7:
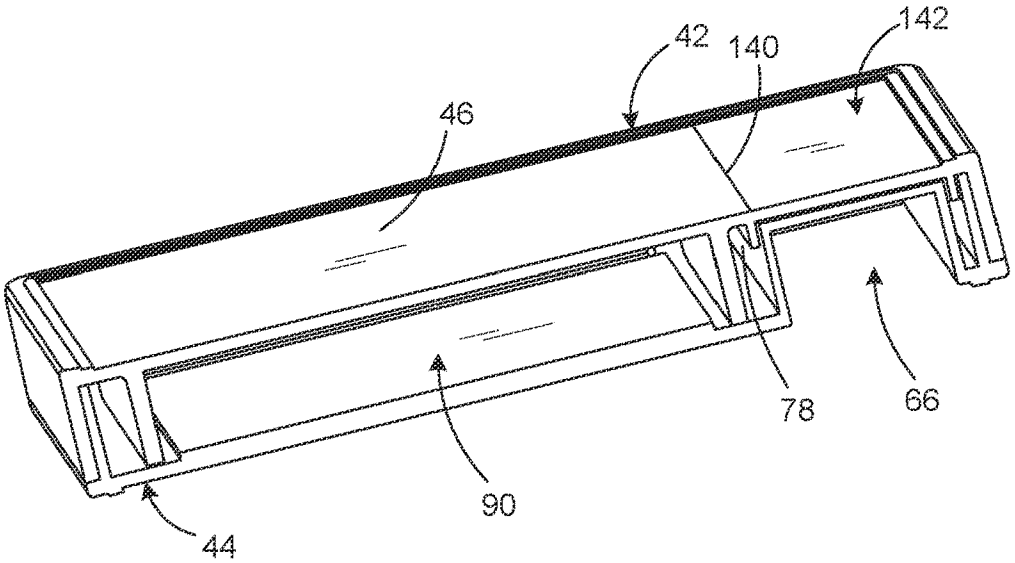
FIG. 7 is a perspective view of the arrangement of FIG. 5.
Figure 8:
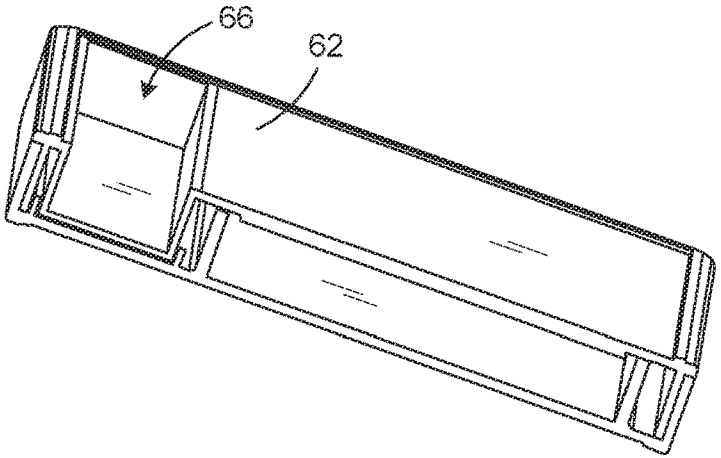
FIG. 8 is another perspective view of the arrangement of FIG. 5.

With reference next specifically to FIGS. 1, 5 and 7, in the illustrated embodiment, a ridge 140 extends forwardly from the front wall 46 generally opposite the bottom portion of the frame wall 76. The illustrated ridge 140 helps define a label portion 142, or information portion, of the holder 40 through which the label 130 is viewable. The portion of the holder below the ridge 140 can be considered a viewing portion 144, through which the collectible item is visible.

As with other such holders, the collectible holder 40 preferably is formed of a transparent plastic so that both the collectible and label 130 indicia enclosed therewithin can be viewed—preferably through both the front housing and back housing.

Figure 6:
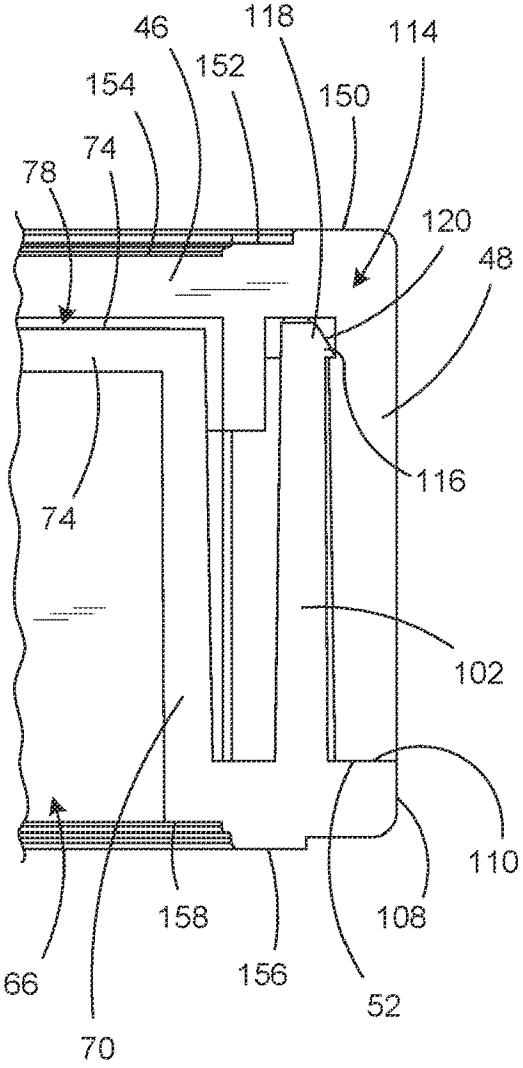
FIG. 6 is a close up view taken along line 6-6 of FIG. 5.
Figure 9:
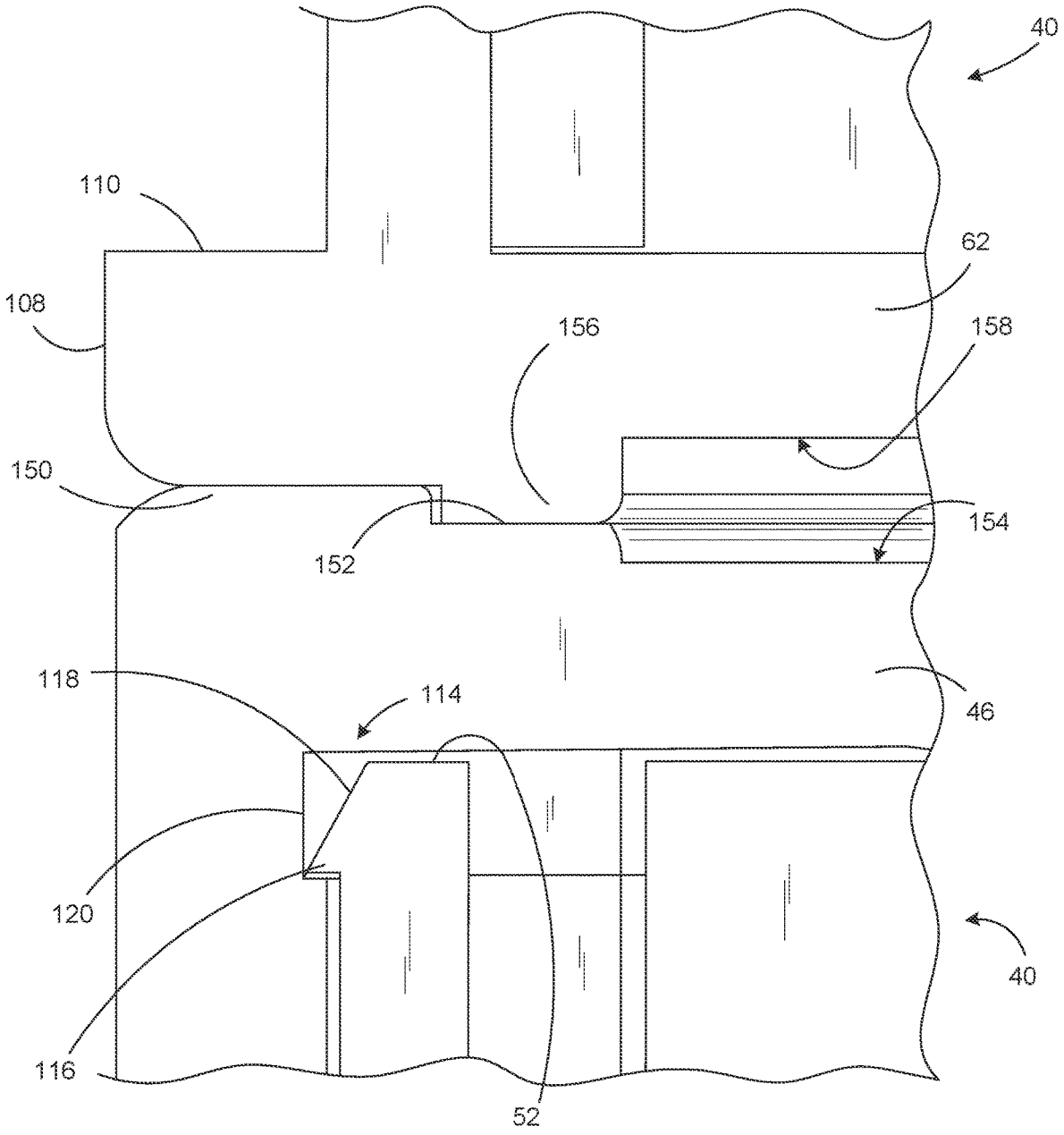
FIG. 9 is a close up cross-sectional view of a pair of the holders of FIG. 5 stacked one atop another.
Figure 10:
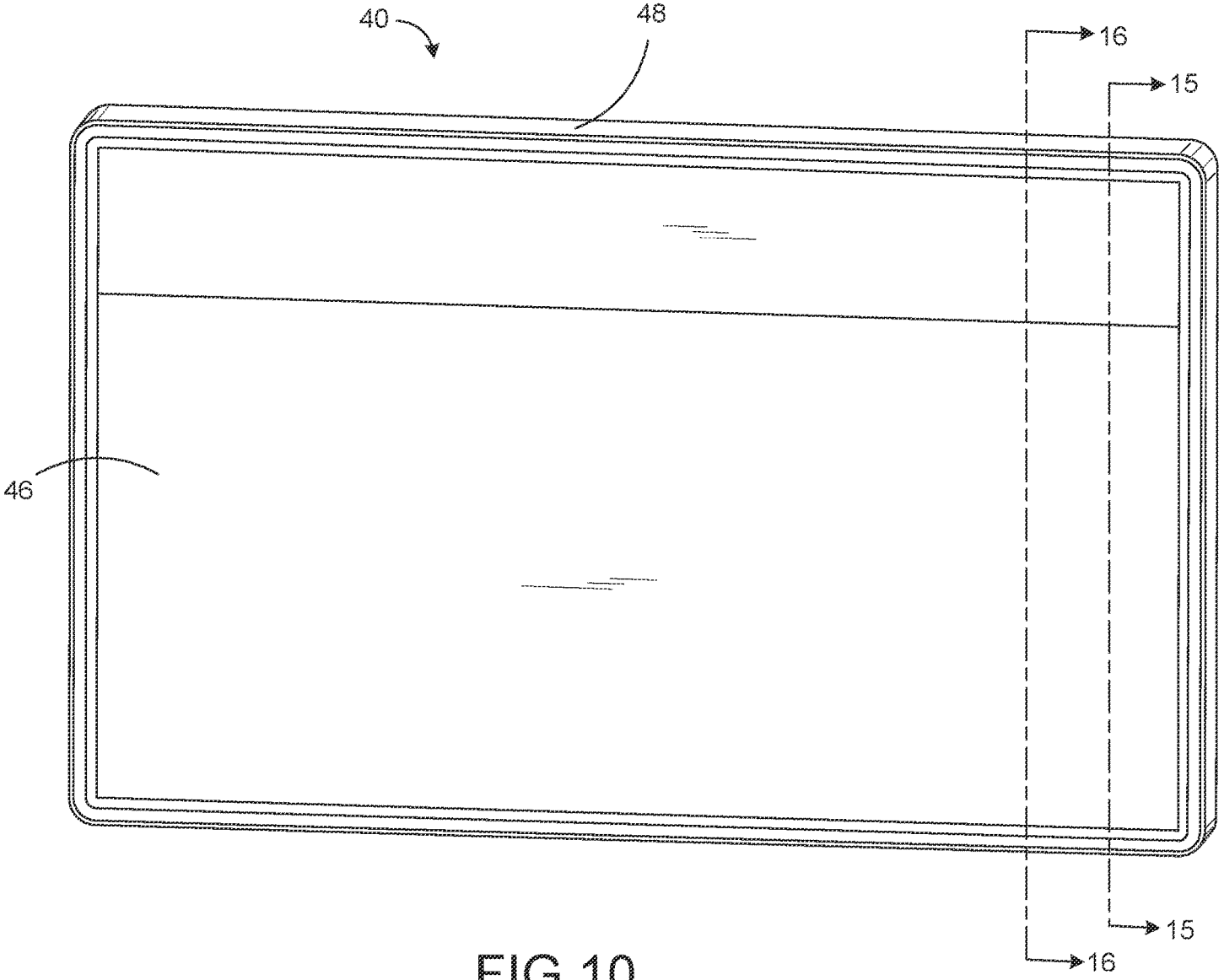
FIG. 10 is a front perspective view of a collectible holder configured in accordance with another embodiment.
Figure 12:
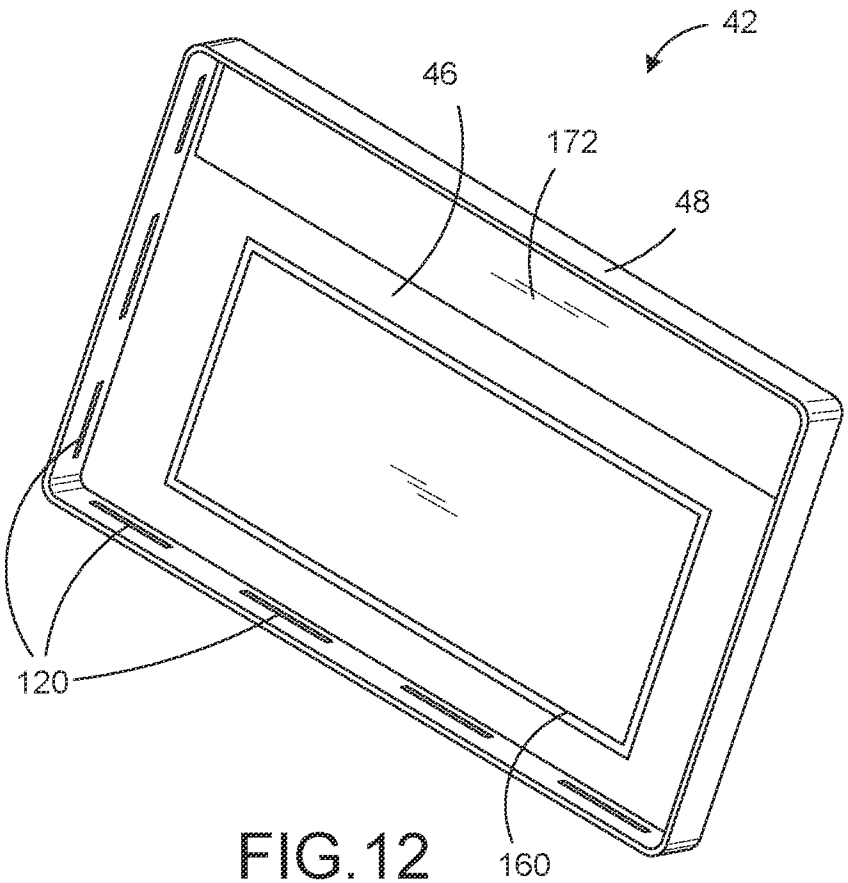
FIG. 12 is a back perspective view of the front housing of FIG. 11.
Figure 11:
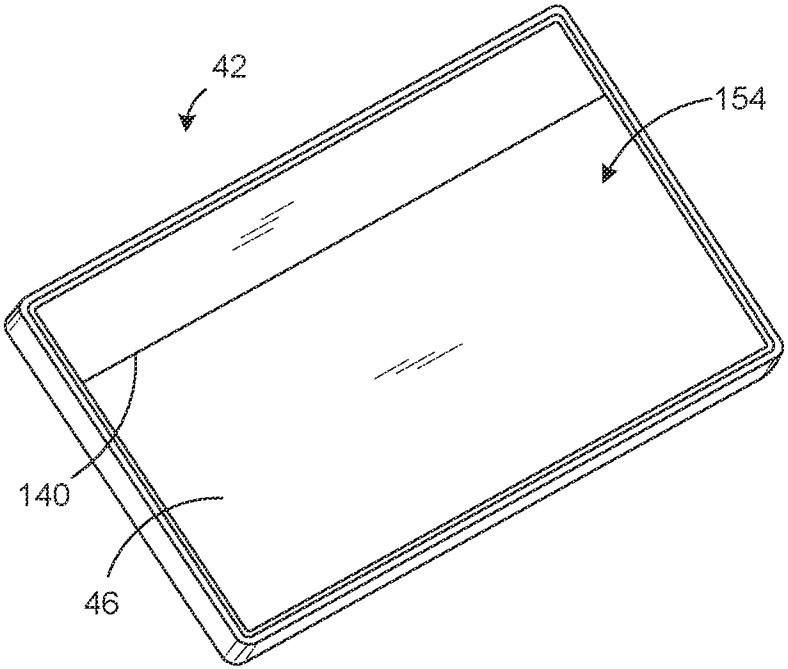
FIG. 11 is a front perspective view of a front housing of the holder of FIG. 10

The illustrated holder 40 is stackable with other holders having similar designs. With particular reference to FIGS. 6 and 9, in the illustrated embodiment, a raised edge 150 is provided circumferentially about the edge of the front housing 42. Preferably the raised edge 150 is flat along its front face. A receiving surface 152 is defined adjacent the raised edge 150 and is offset from the front surface of the raised edge 150. Preferably, the receiving surface is also flat. A front face 154 of the front wall 46 is offset from both the front surface of the raised edge 150 and the receiving surface 152.

A raised ridge 156 extends from the back wall 62 of the back housing 44 and is spaced from the edge 108 of the back wall 62 a distance approximately the same as a width of the raised edge 150 on the front wall 46. Preferably, a back surface of the raised ridge 156 is flat. In the illustrated embodiment, a back face 158 of the back wall 62 is offset from the raised ridge 156.

FIG. 9 shows a close up cross-section of a portion of the edges of adjacent holders 40 stacked one atop the other. The structures depicted in FIG. 9 are similar to the structures in the cross-section depicted in FIG. 5, but stacked one on top of the other. As shown, the raised ridge 156 of the back housing 44 is located inwardly of the raised edge 150 of the front housing 42 so that the flat back surface of the raised ridge 156 engages and rests upon the receiving surface 152 of the front housing 42. The back wall 62 outwardly of the raised ridge 156 preferably also rests upon the front surface of the raised edge 150 of the front wall 46. The front face 154 of the front wall 46 and the back face 158 of the back wall 62 preferably are spaced apart from one another.

The embodiment illustrated in FIGS. 1-9 is particularly amenable to holding a stack of currency 122 (see FIG. 3A). As such, the placement of the receiver walls 102, 104, 106 is selected to match the rectangular dimensions of a particular type of currency—or to safely hold rectangular currency having a particular range of dimensions. The distance between the platform surface 96 and front wall inner surface is also selected to accommodate a specific number of bills—such as 20, 50, or 100 bills. It is to be understood that holders having features as described above can be configured with different specific placement of receiver walls and different distances between the platform surface and the front wall so as to accommodate currency having a different range of dimensions and/or a different number of bills. In a preferred embodiment a kit or set of collectible holders can be selected such that internal dimensions of different holders within the set may vary, but two or more of the outer dimensions (such as two or more of length, width and height) remain the same. As such, holders configured to hold different size ranges and numbers of bills can still be readily stackable one atop another, and easily stored.

With referenced next to FIGS. 10-20, another embodiment of a collectible holder 40 is shown. In the illustrated embodiment, the receiver space 90 is formed by a plurality of receiver walls 82, 84, 86 that extend from the back wall 62 of the back housing 44. A platform 94 is also formed extending from the inner surface of the back wall 62 within the receiver space 90. Side edges 100 of the platform 94 are spaced from adjacent receiver walls 82, 84, 86. A channel 160 is formed in the inner surface of the front wall 46 of the front housing 42. The channel 160 is configured so that when the front and back housings 42, 44 are assembled, the tips 52 of the receiver walls 82, 84, 86 fit into and are received within the channel 160, as best shown in FIGS. 15-18.

Figure 14:
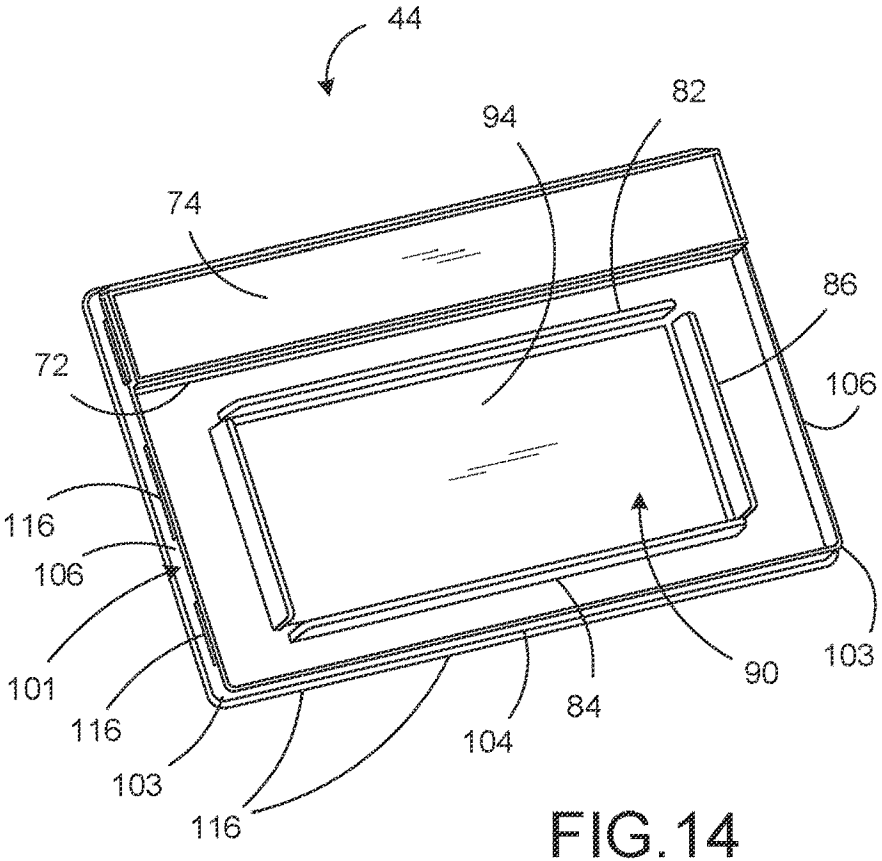
FIG. 14 is a front perspective view of the back housing of FIG. 13.
Figure 13:
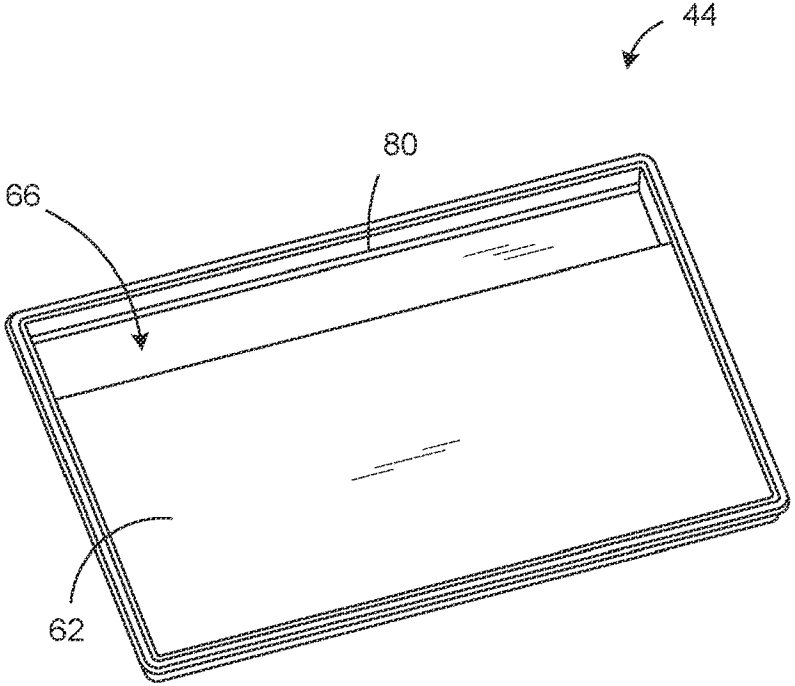
FIG. 13 is a back perspective view of a back housing of the holder of FIG. 10.

As in previous embodiments, the outer wall 48 extends from the front wall 46 of the front housing 42 and is substantially contiguous about its entire perimeter. As shown in FIG. 14, the lock wall 104 is contiguous about its entire perimeter, and extends from the back wall 62 of the back housing 44 and is spaced from the edge 108 of the back wall 62. Specifically, the illustrated lock wall 101 has opposing top and bottom side lock wall portions 102, 104 and opposing end lock wall portions 106 that are joined end-to-end with one another at curving corners 103. In the illustrated embodiment, the lock wall 101 is configured so that its tip 52 is a spaced from the front wall 46 of the front housing 42 when the front and back housings 42, 44 are assembled. In a preferred embodiment, the height of the lock wall 101 from the back wall 62 to the lock wall tip 52 is just over half the length of the outer wall 48 from the front wall 46 to the outer wall tip 52. It is to be understood that a height of the lock wall 101 from base to tip preferably is in a range of one quarter to about the same as a height of the outer wall 48 from base to tip. Preferably, the locking structure 114 is spaced from the outer wall tip 52 so that the locking structure is not accessible from outside an assembled collectible holder 40.

A locking structure 114 is provided to interact between the lock wall portions 102, 104, 106 and the outer wall 48. As shown, a plurality of spaced apart catches 116 are formed on the lock wall 101. Each catch 116 is elongated and extends along the length of the respective wall for only a portion of the length of the respective lock wall portion 102, 104, 106. Ends of the adjacent catches 116 are spaced apart from one another, and in the illustrated embodiment there is no locking structure between the catches 116. The outer wall 48 includes a corresponding plurality of spaced apart lock receivers 120. In the illustrated embodiment the lock receivers comprise elongated slots 120 formed along the inside surface of the outer wall 48 and located to correspond to the positions of the catches 116 on the lock walls 102, 104, 106 of the back housing 44.

Figure 15:
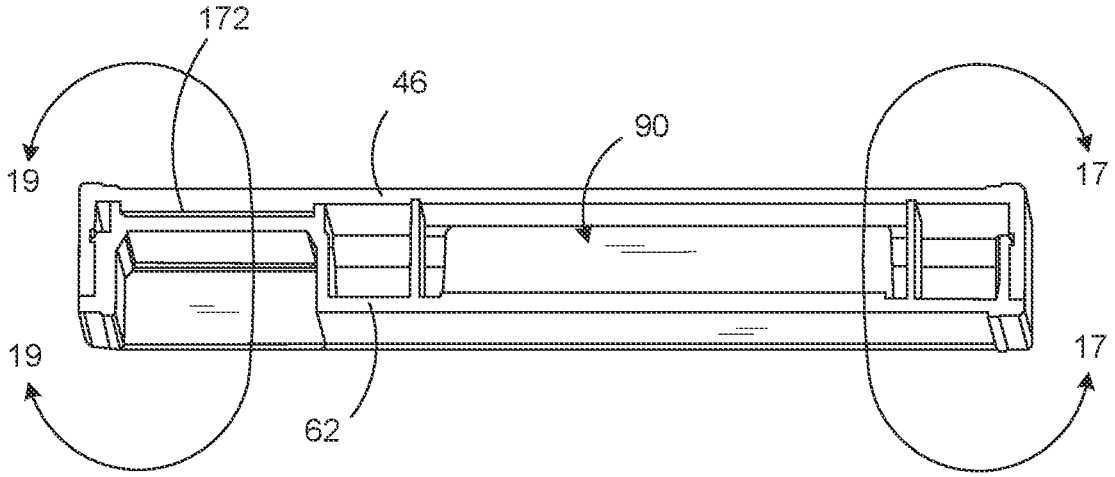
FIG. 15 is a cross-sectional view taken along line 15-15 of FIG. 10.
Figure 17:
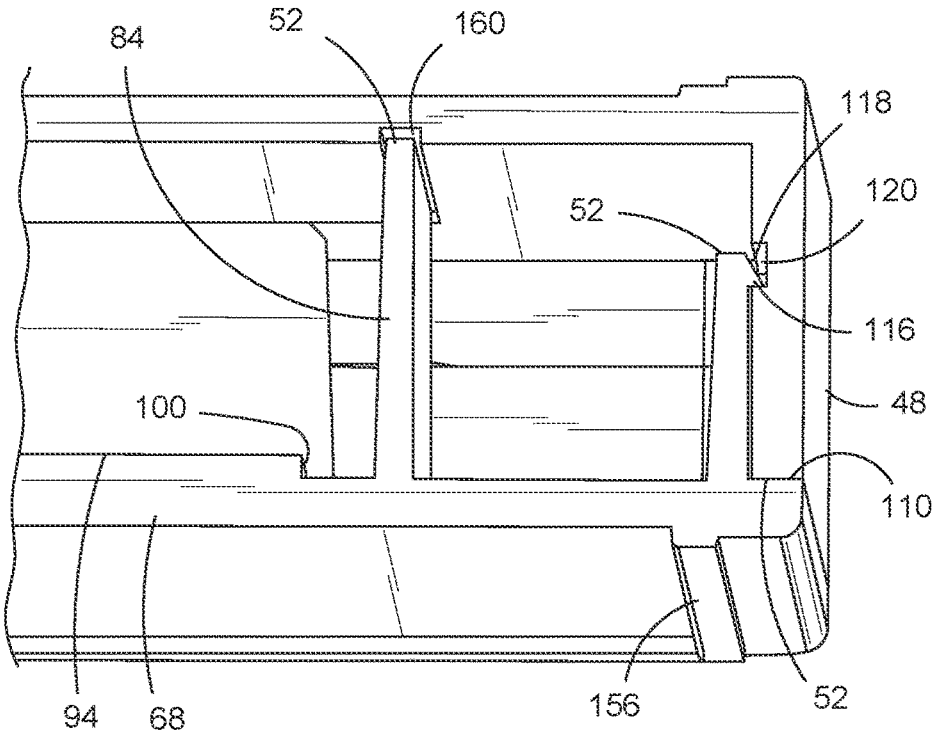
FIG. 17 is a close-up view taken along lines 17-17 of FIG. 15.

With particular reference next to FIGS. 15 and 17, during assembly of the front and back housings 42, 44, the tapered slide surface 118 of the lock wall catch 116 can be expected to slide across the inner surface of the outer wall 48, causing one or more, or all, of the lock wall, outer wall and catch to deflect somewhat until the catch 116 reaches the lock receiver 120 and snaps into place. When fully assembled, the catch 116 is engaged within the lock receiver 120 so as to resist any force to tending to disassemble the front housing 42 from the back housing 44. Similarly, the outer wall tip 52 is abutted with the back wall edge surface 110. In the illustrated embodiment, a thickness of the lock wall may be somewhat less than a thickness of the outer wall 48. As such the lock wall 101 and/or catch 116 may be preferentially inclined to deflect during the assembly process.

Figure 16:
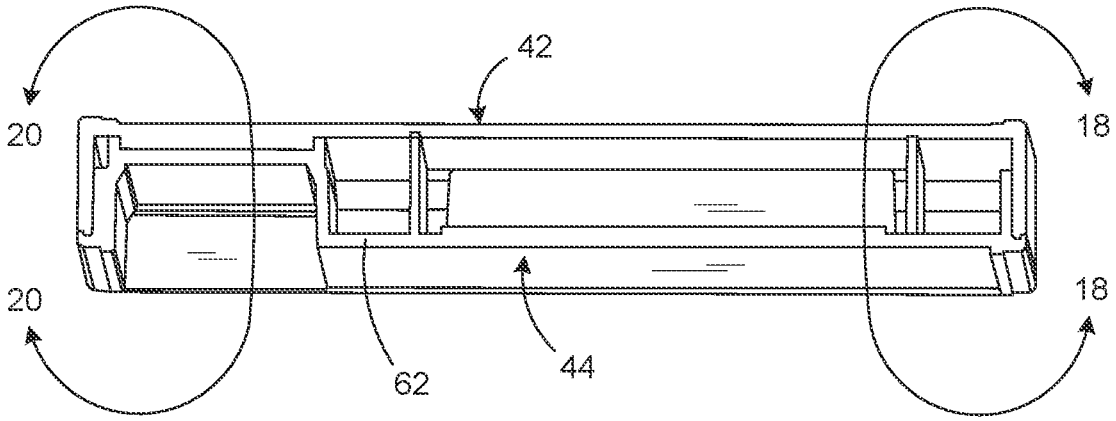
FIG. 16 is a cross-sectional view taken along line 16-16 FIG. 10.
Figure 18:
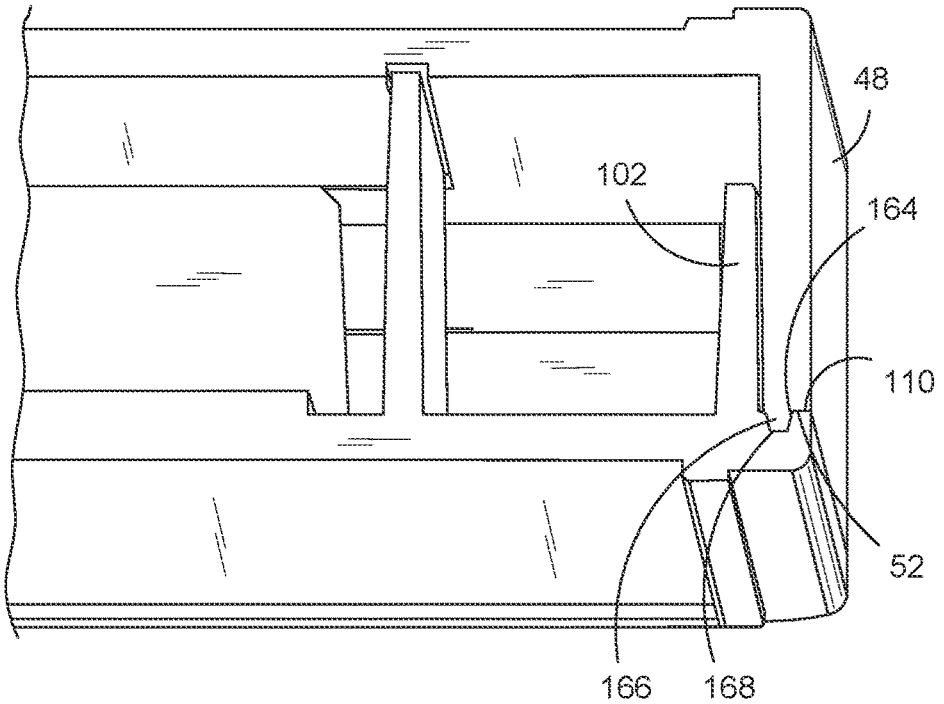
FIG. 18 is a close-up view taken along line 18-18 of FIG. 16.
Figure 19:
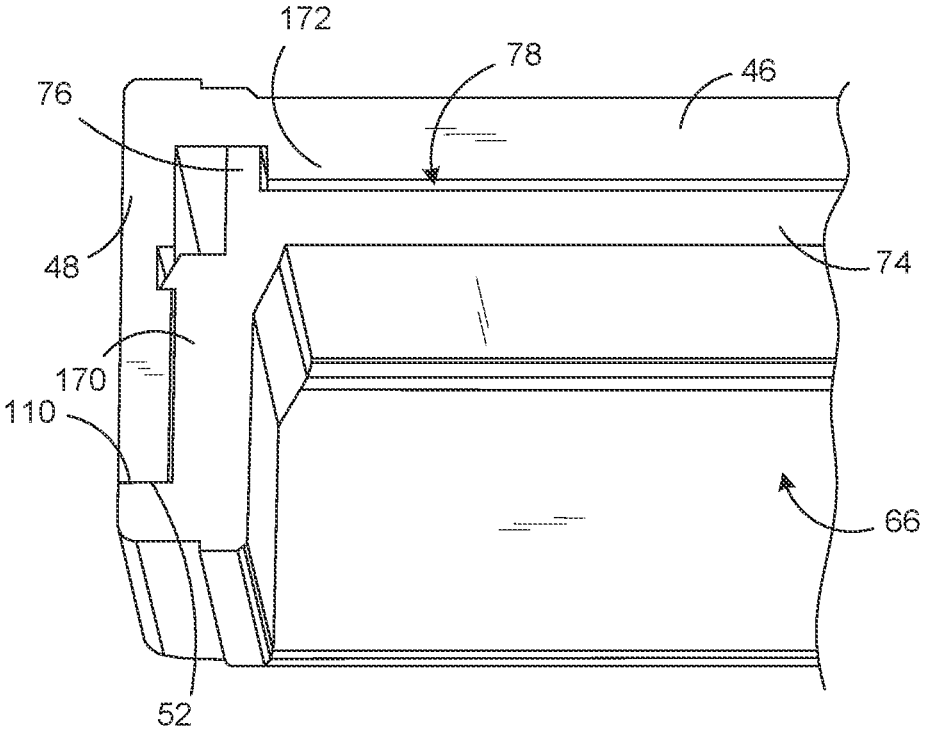
FIG. 19 is a close-up view taken along line 19-19 of FIG. 15.
Figure 20:
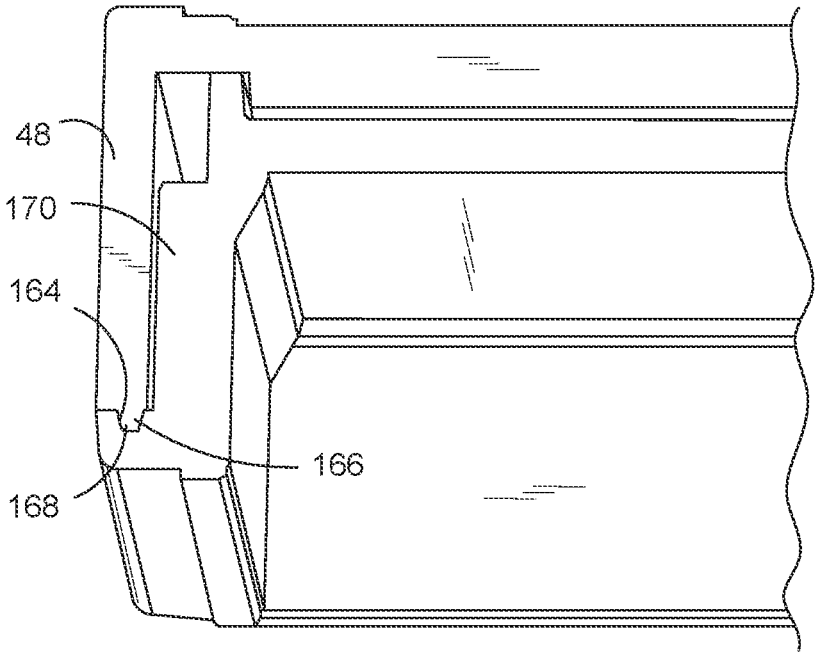
FIG. 20 is a close up view taken along line 20-20 of FIG. 16.
Figure 21:
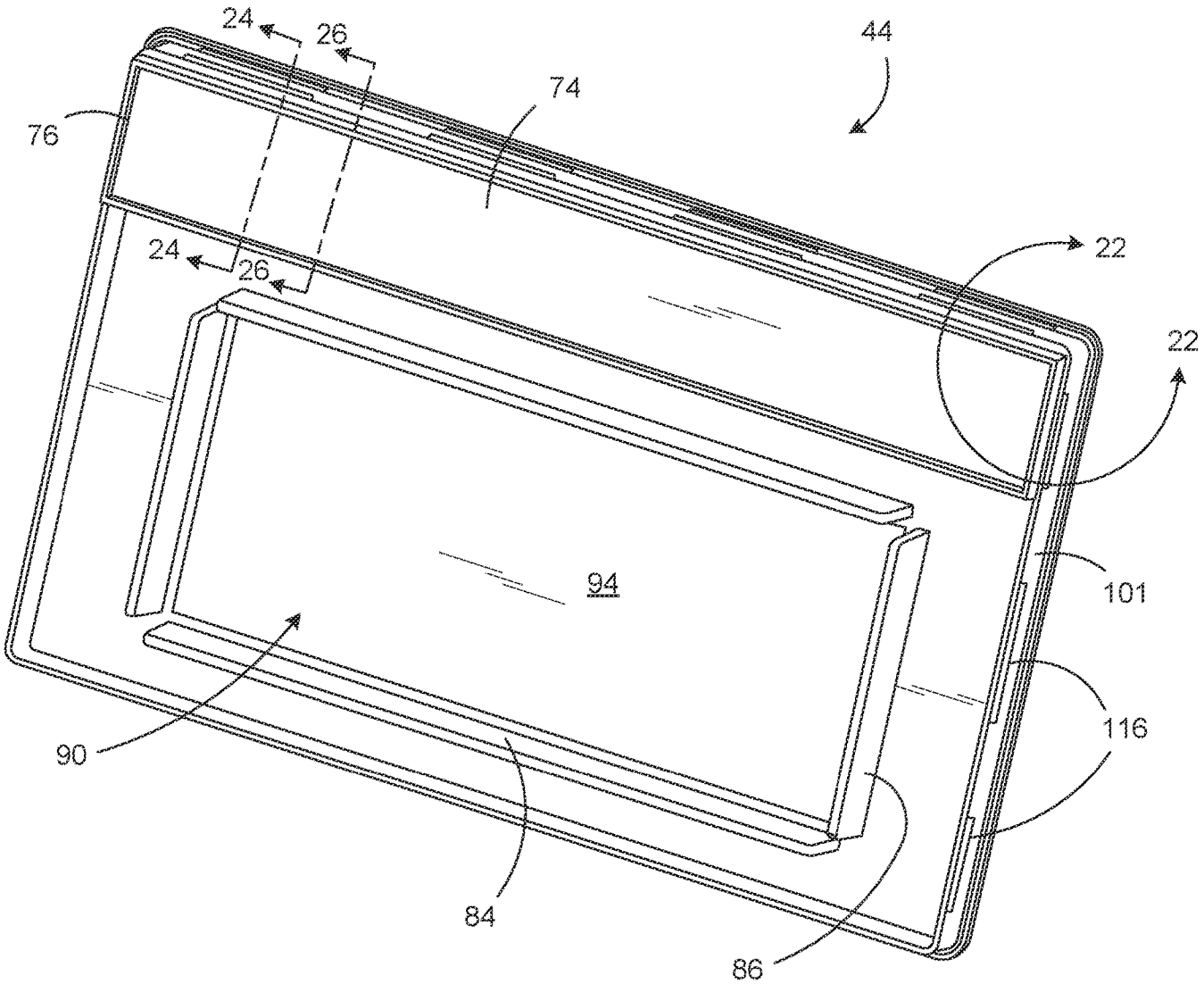
FIG. 21 is a back perspective view of an embodiment of a back housing constructed in accordance with another embodiment.
Figure 22:
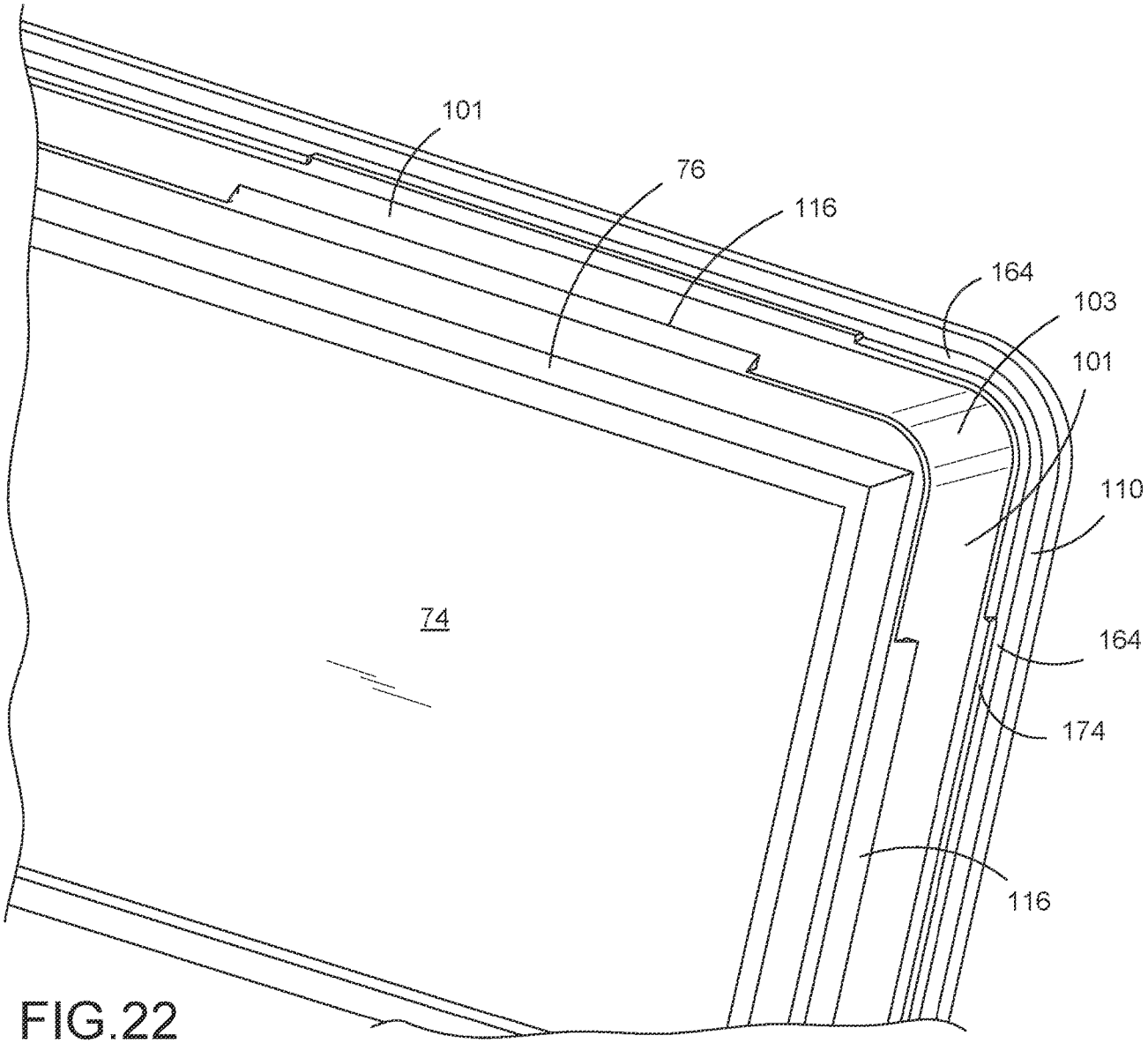
FIG. 22 is a close-up view taken along line 22-22 of FIG. 21.
Figure 23:
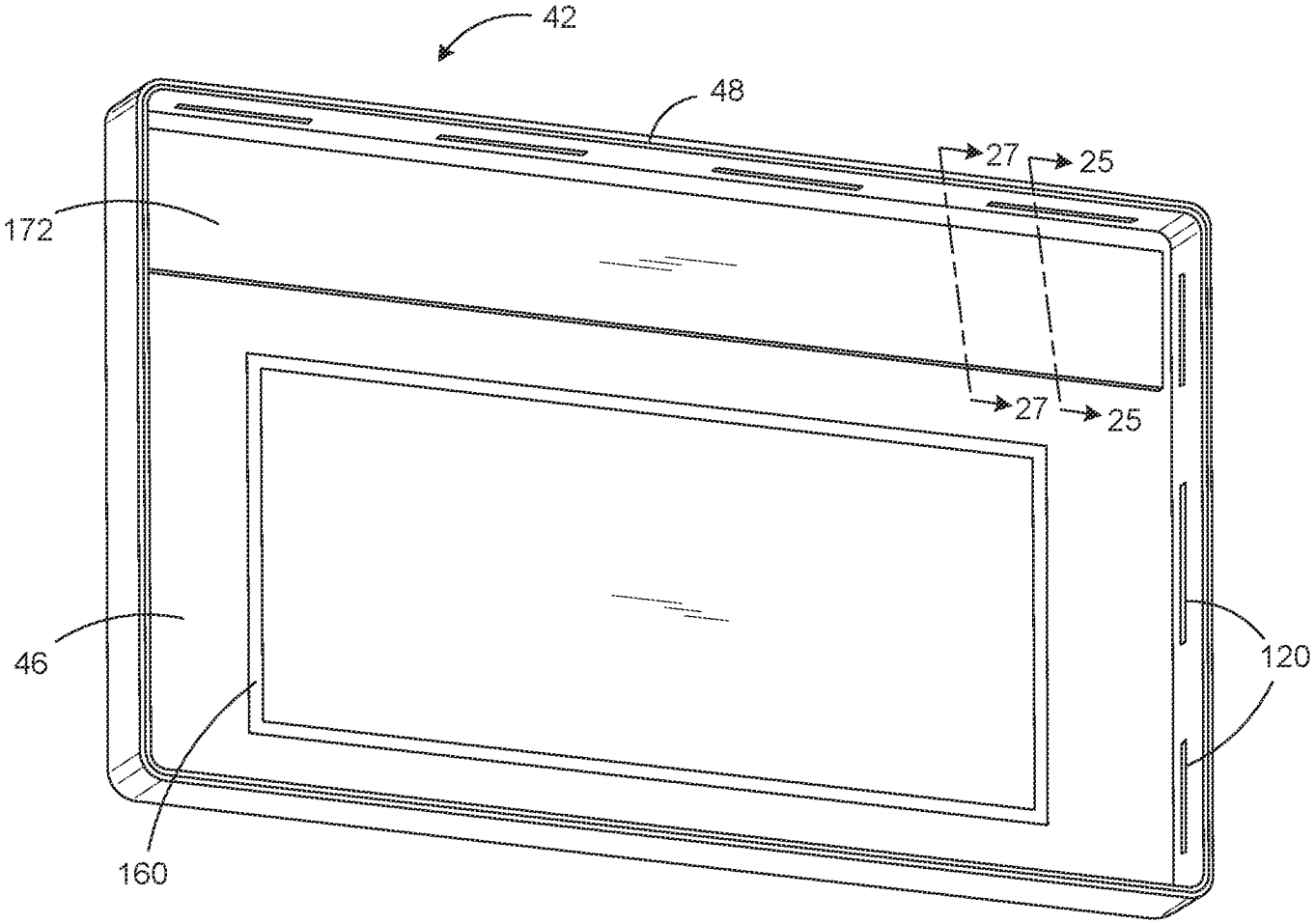
FIG. 23 is a back perspective view of a front housing configured to be assembled with the back housing of FIG. 21.
Figure 24:
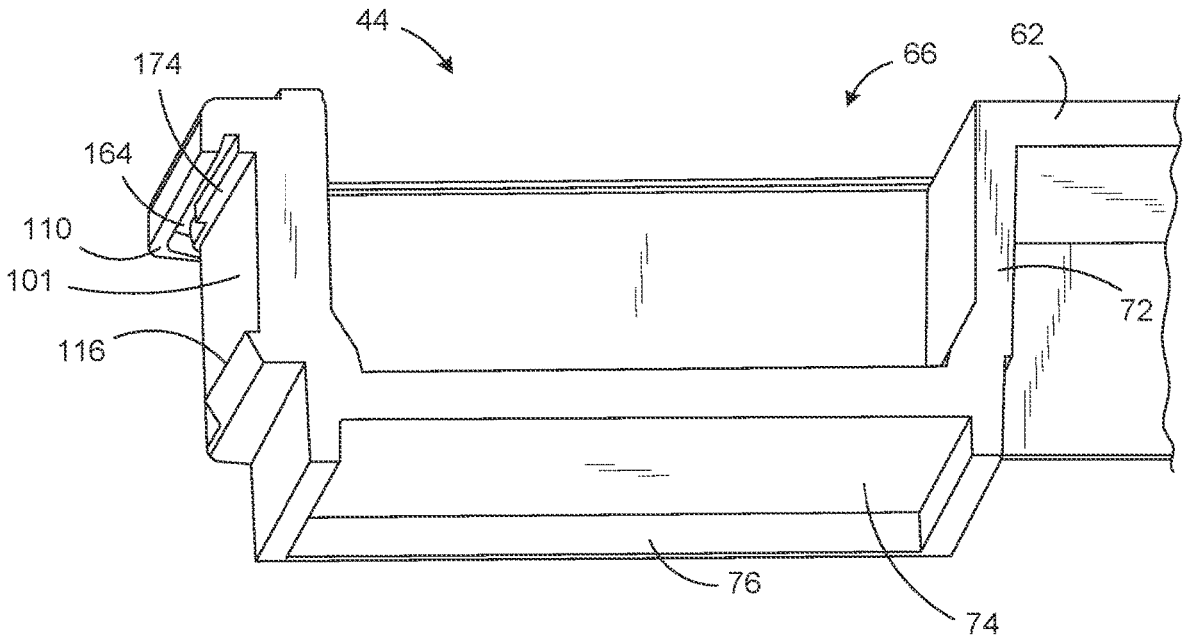
FIG. 24 is a cross-sectional view taken along line 24-24 of FIG. 21, depicting a portion of the back housing that can fit into the front housing portion of FIG. 25.
Figure 25:
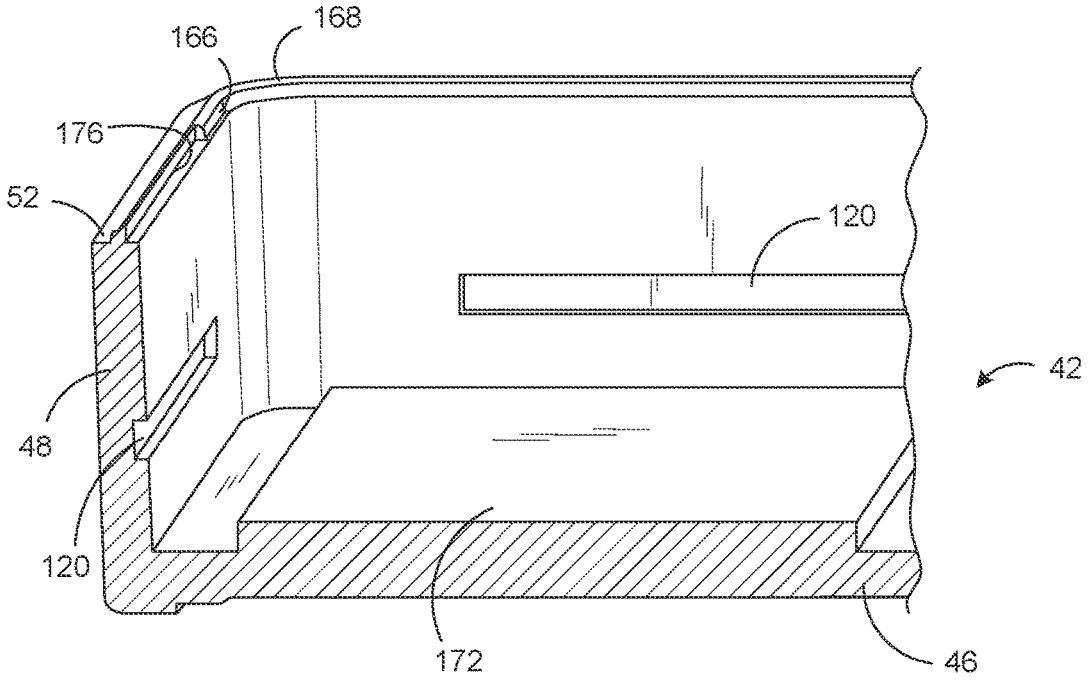
FIG. 25 is a cross-sectional view taken along line 25-25 of FIG. 23, depicting a portion of the front housing that can receive the back housing portion of FIG. 24.
Figure 26:
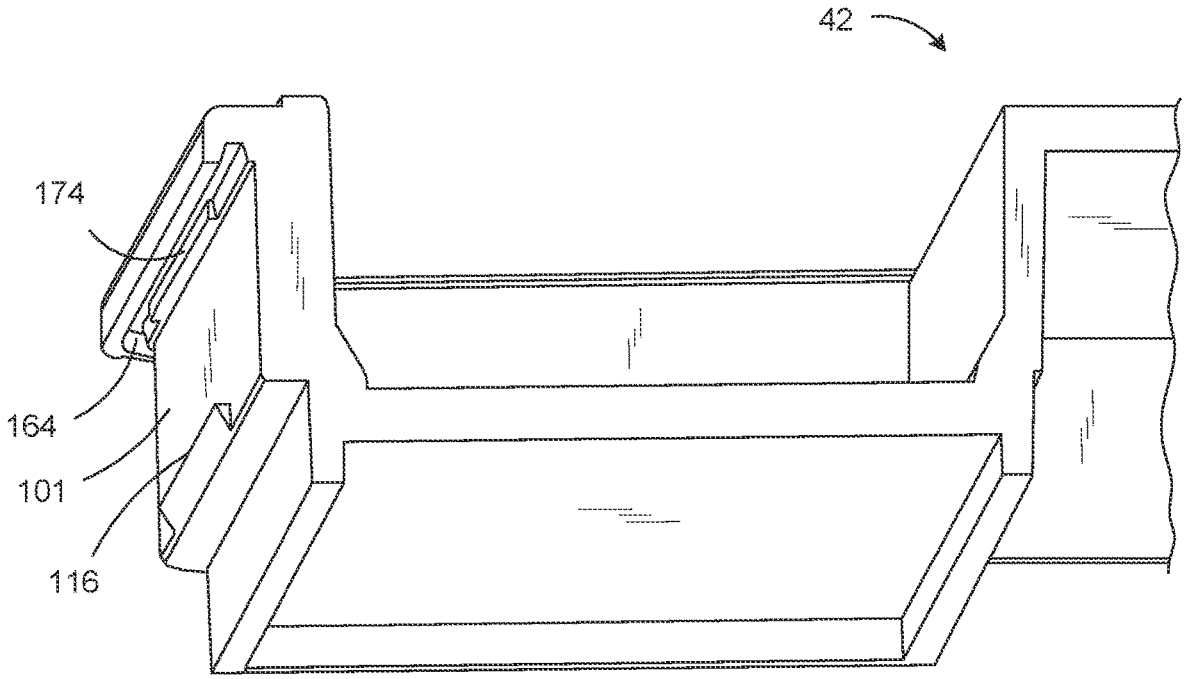
FIG. 26 is a cross-sectional view taken along line 26-26 of FIG. 21, depicting a portion of the back housing that can fit into the front housing portion of FIG. 27.
Figure 27:
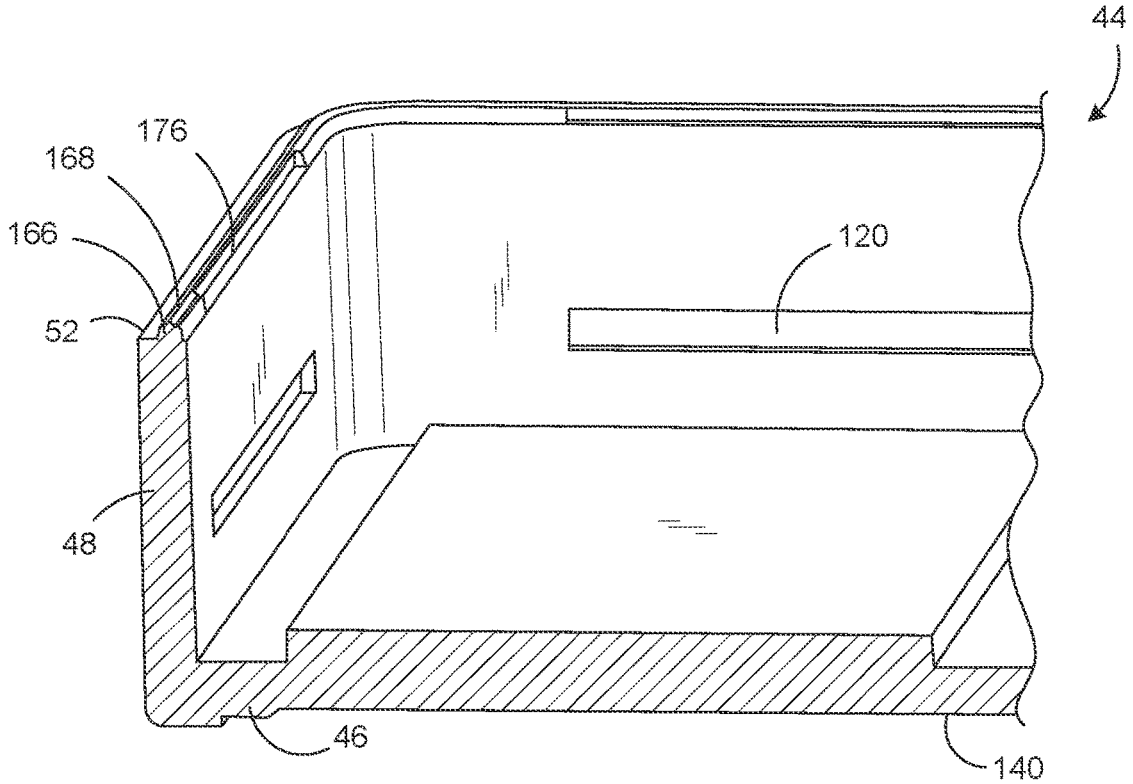
FIG. 27 is a cross-sectional view taken along line 27-27 of FIG. 23, depicting a portion of the front housing that can receive the back housing portion of FIG. 26.

With additional reference to FIGS. 16 and 18, the elongated portions of the lock wall 101 that do not include a catch can be expected to be aligned immediately adjacent the outer wall 48 when the front and back housings 42, 44 are assembled. In the illustrated embodiment, a plurality of spaced apart grooves 164 are formed in the back wall edge surface 110. The illustrated grooves 164 are located so as to exist only—or mostly—so as to be aligned with portions of the lock wall 101 that do not have a catch 116. Thus, the grooves 164 are formed in the spaces between catches. A plurality of complementarily-formed tongues 166 preferably extend from the outer wall tip 52, and are located, sized and configured to align with and fit into the back wall edge surface grooves 164. As such, when the front and back housings 42, 44 are assembled, not only are the catches 116 received into the lock receivers 120, but the tongues 166 of the outer wall 48 are received into and aligned with corresponding grooves 164 of the back wall edge surface 110.

In a preferred embodiment, energy directors 168 are provided along the ends of the tongues 166. As such, once the collectible holder 40 is assembled, and the locking structure engaged, an ultrasonic welding process can be performed, ultrasonically welding the tongues 166 of the front housing 42 to the grooves 164 of the back housing 44. In this manner, not only are the front and back housings 42, 44 held snugly together by the engaged mechanical lock structure but also by an ultrasonic weld between engaged housings. In the illustrated embodiment, the front and back housings 42, 44, then, are attached to one another by multiple methods and structures substantially about the entire periphery of the assembled holder 40.

With continued reference to FIGS. 15-18, the cross-sectional view shows the tip 52 of the receiver wall 82 received into the front wall channel 160 formed in the inner surface of the front wall 46 of the front housing 42. In the illustrated embodiment, the height, or distance from the base to the tip of the receiver wall 82, is slightly (such as preferably less than 2 mm, and more preferably less than 1 mm) greater than a distance between the inner surfaces of the front and back walls 46, 62 when the front and back housings are assembled. As such, the tips 52 of the receiver walls 82. 84. 86 extend beyond the inner surface of the front wall 46 and into the channel 160. In another embodiment, energy directors can be provided on all or a portion of the receiver wall tips. As such, after the front and back housings are assembled, the tips can be ultrasonically welded within the channels.

With reference next to FIGS. 15, 16, 19 and 20, the top side lock wall and top side trough wall are co-formed as a single composite wall 170, resulting in a particularly thick lock/trough wall 170 along the top side of the back housing 44. Preferably, the portions of the end lock walls that co-extend with the end trough walls are also co-formed with the trough walls. As such, the lock walls 102, 106 along the top side and along portions of the ends are much thicker, such as between 1.5-2.5 times thicker, than the lock walls 104, 106 in other portions of the back housing 44. Not surprisingly, it can be expected that the lock walls in these thickened portion are much less likely to deflect inwardly during assembly, when the outer wall 48 is forced over the lock wall 101, than are other portions of the lock wall. Such resistance to deflection can be further enhanced by lock wall structures, and outer wall structures, in which wall portions are connected at the corners, further limiting the walls' propensity to deflect. In some embodiments it may entail exertion of significant force, then, to assemble the front and back housings. Some users may even wish to use a mallet-like device to assist in assembling the housings. However, once assembled it will be all the more difficult to deflect either or both of the outer wall and lock wall in an effort to disengage the catch 116 from the lock receiver 120. Indeed, disassembling the collectible holder will necessitate destruction of the engaged housings.

Continuing with reference to FIGS. 12-16, 19 and 20, a portion of the trough side and end walls 72, 68 extends beyond the label wall, 74 to define a frame wall, 76 substantially surrounding the label wall, 74. In the illustrated embodiment, a label platform 172 extends from the inner surface of the front housing front wall, terminating in a label platform surface. The label platform 172 is dimensioned so as to fit complementarily within the frame wall 76 so that a label space 78 is defined between the label platform 172 surface and the label wall 74. Preferably, the label space 78 is quite small, such as less than the thickness of a few sheets of paper. Preferably the label space 78 is configured to accommodate label indicia as discussed herein, including indicia and structure for identifying, validating, securing, etc. the collectible stored in the collectible holder.

With reference next to FIGS. 21-27, another embodiment of a collectible holder 40 demonstrates another variation of structure for maintaining the holder in the assembled position once the front and back housings 42, 44 have been assembled. In the illustrated embodiment, the lock wall 101 is contiguous about the circumference of the back wall 62, in that side portions 102, 104 and end portions 106 of the lock wall 101 are joined end to end at corners 103. A plurality of elongated catches 116 extend outwardly from the lock wall 160. Such catches 116 are spaced apart from one another.

In the illustrated embodiment, a groove 164 is formed in the back wall edge surface 110 about the circumference of the back wall 62. The illustrated groove 164 includes a key structure 174 extending into the channel 164, but only in portions of the channel 164 that are aligned with a catch 116 formed on the adjacent lock wall 101. As such, the groove 164 has a different cross-sectional shape in portions that are aligned with catches 116 than in other portions of the groove 164. A tongue 166 extends from the tip 52 of the front housing outer wall 48 about the circumference of the outer wall 48. The tongue 166 is sized and configured to fit within the groove 164 when the front and back housings 42, 44 are assembled. A key cavity 176 is formed in the tongue 166 at each location that is expected to meet up with a key structure 174 of the groove 164, and as such the tongue 166 and groove 164 are complementarily shaped so as to register with one another so as to establish and maintain proper alignment of the assembled front and back housings 42, 44. An energy director 168 can be provided on the tongue 166, around a portion or about the entire circumference of the outer wall 48. As such, after the front and back housings 42, 44 are assembled and mechanically locked together by the lock structure, and maintained in proper alignment by the engaged tongue 166 and groove 164, the structures can also be ultrasonically welded to one another if desired.

Figure 28:
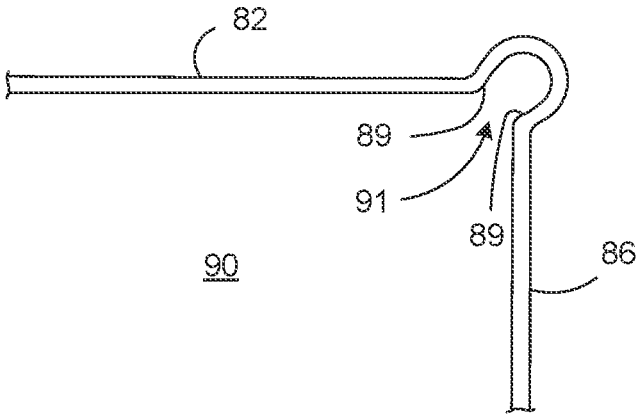
FIG. 28 is a cutaway view of a portion of another embodiment of a collectible holder.

With reference next to FIG. 28, in accordance with another embodiment, an extension 180 can be provided to connect ends 89 of adjacent receiver walls 82, 86. In the illustrated embodiment, the receiver walls 82, 86 terminate at ends 89 in a manner similar as discussed above. As such, an open corner 91 is defined between the adjacent ends 89. The extension is a curvate wall that is contiguous with both the to receiver side wall 82 and receiver end wall 86, but extends from each end 89 in a direction away from the receiver space 90, curving to change directions at a portion spaced from the open corner 91 so as not to interfere with the open corner.

Figure 30:
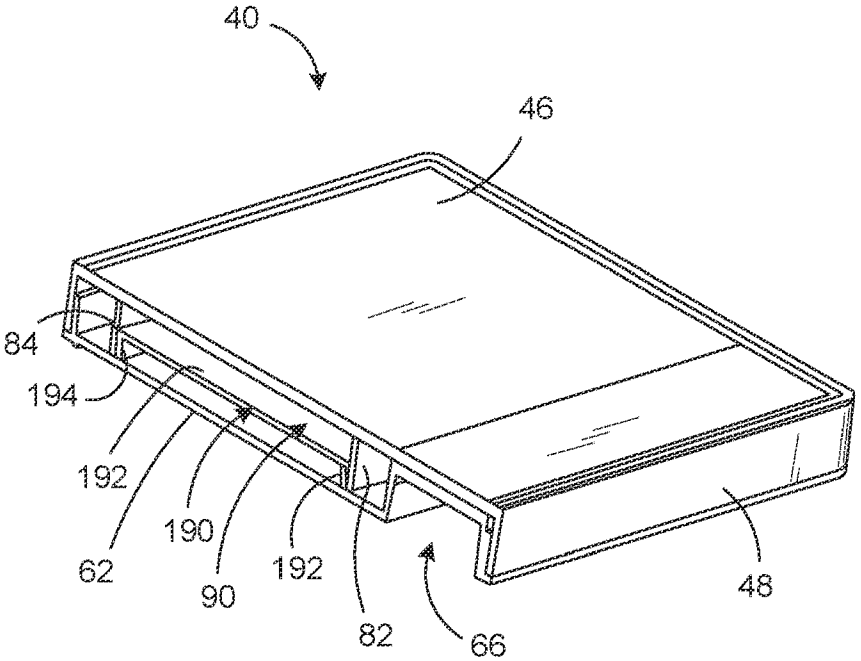
FIG. 30 is a cross-sectional view of the spacer of FIG. 29 arranged within a receiving space of a collectible holder.
Figure 29:
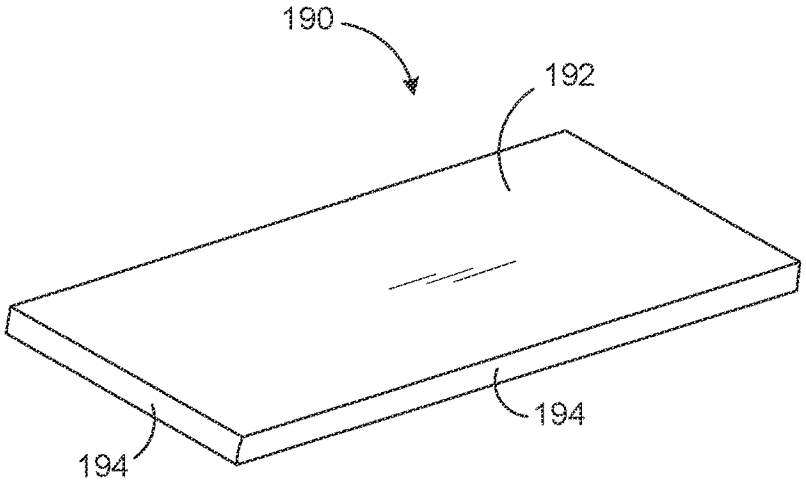
FIG. 29 is a perspective view of a spacer for use in an embodiment of a collectible holder.

With reference next to FIGS. 29 and 30, a spacer 190 is formed separately from the front and back housings 42, 44 and comprises a flat front spacer wall 192 from which side walls 194 depend. Preferably the front wall 192 is shaped to fit complementarily between the receiver walls 82, 84, 86 within the receiver space 90, with the side walls 194 engaged with the back wall 62 so that the front spacer wall 192 is spaced from the back wall. By inserting the spacer 190 into the receiver space 90 the effective depth of the receiver space 90 is reduced. A spacer 190 can be of particular utility when placing a collectible within the receiver space 90 whose thickness is substantially less than the height of the receiver space 90. For example, a relatively short stack of currency may not fill the entire receiver space 90. By inserting the spacer 190 into the receiver space 90 and then placing the short stack of currency atop the front spacer wall 192, the currency will still appear from the front to fill the receiver space 90 and will be held securely therewithin with little or not play.

Each of the collectible holder embodiments described herein has been specifically tailored to enclose a stack of currency/bank notes. This has been helpful for providing a context for discussing the inventive features. It is to be understood, however, that the principles discussed herein can be applied to holders having differing shapes and being specifically designed for other types of collectibles, such as coins, sports cards, stamps, figurines, models, and the like. Dimensions and shapes for such holders may, for example, involve square, circular, oval or otherwise-shaped receiver portions, and similarly may be rectangular, square, circular, oval or otherwise-shaped in their outer dimensions. Such holders can also come in a wide variety of heights depending on the number and type of collectible to be held therewithin.

Further, this description has employed terms such as "front", "back", "top" and "bottom" in order to aid discussion and demonstrate relative positioning of some described structures. Use of such terms is not intended to be limiting. Structure described herein should not be limited to only being associated with a "front", "back" or the like of any holder. To wit, the back housing could have just as easily and appropriately been referred to as the "front housing", "bottom housing", "top housing", "first housing", "second housing", or the like.

Figure 31:
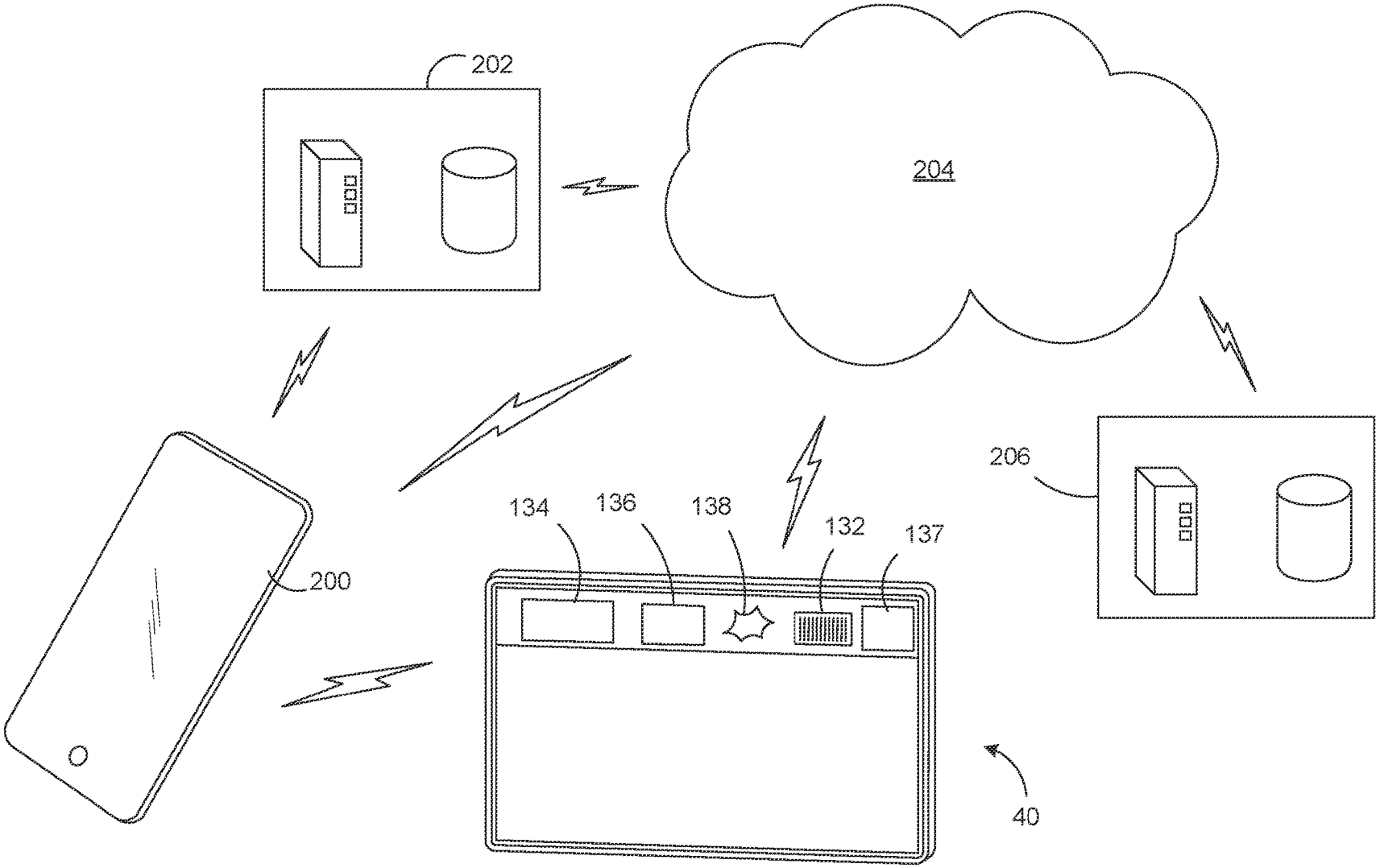
FIG. 31 is a schematic view of one embodiment of a system for controlled dissemination of information about a collectible item.

As discussed above, label indicia included in the label space may include one or several items related to information dissemination, security and verification. FIG. 31 depicts a schematic representation of a collectible holder 40 having multiple label indicia including, for example, written indicia 137 which may include written information about the associated collectible and/or a grading organization, a hologram 138 attesting to the authenticity of the collectible and grading, and a bar code 132 or other symbol that can be scanned to track movement of the collectible holder and/or direct a user to an online repository of information about the associated collectible. An RFID tag 134 can also be supplied to supply information about the associated collectible to a scanning device such as a computing device which, in some instances can be a handheld computing device such as a smartphone. An NFC tag 136 can further be supplied to selectively communicate with a computing device 200 upon specific request by the computing device 200 (such as by tapping the computing device on the collectible holder). In some embodiments, other types of indicia and electronic communication devices can be included in the collectible holder, and not necessarily limited to placement in the label space.

Electronic communication devices such as the RFID or NFC tags 134, 136 can communicate information about the associated collectible to the associated computing device 200, and/or can communicate a link to the computing device 200 that the computing device 200 can use to access an online repository of information about the associated collectible. For example, a user of the computing device 200 can be given a link to a webpage maintained on or by a system 202 of the grading organization. The web page can include information about the associated collectible with any desired level of detail, and the computing device 200 can access the web page via a network 204 such as the internet/cloud. In some embodiments, an electronic communication device on the collectible holder 40 can obtain some information from the computing device 200—such as identifying information about the user of the device—and communicate such information through a local area network and further through the cloud to the grading organization's system 202. In other embodiments, however, in order to keep costs and power requirements down, electronic tags can be configured to use minimal power to communicate small snippets of information, such as is the case with NFC tags 136 and some RFID tags 134.

In some embodiments it may be desired to disseminate some information about the collectible item encased in a collectible holder 40, but to reserve dissemination of detailed information to selected users, such as potential buyers that are actually present in the proximity of the collectible. With continued reference to FIG. 31, in one embodiment, the NFC tag 136 has been programmed with a link/URL pointing to a web page of the grading organization (or collectible owner, or another party). The particular web page includes detailed—and perhaps even extensive—information about the associated collectible. For example, this information may include not only grading information about the particular collectible item, but also verification of its identification, identification of past owners, reports of testing that may have been performed on the item, pricing and sales history, and/or additional information.

When a user taps their computing device 200 on the collectible holder 40, the NFC tag 136 generates a unique cryptographic code, which is appended as a parameter of the URL, and communicates the information to the computing device 200. The user's computing device then accesses the URL via, for example, the Internet 204. The grading organization's system 202 removes the cryptographic code from the URL and communicates with the security service's system 206, which can verify whether the cryptographic code is authentic—meaning obtained by a physical tap of the NFC tag 136 or simply a copied URL from another user's tap. The security system thus can determine whether the attempt to access the URL is from a user physically at the location of the collectible item or somewhere else. The security service's system 206 can relay this information to the grading organization's system 202, and based on this information the grading organization's system can decide whether to allow access to the detailed web page. In one embodiment, the grading organization's system 202 allows access to the detailed web page only to users that are verified to have physically tapped the collectible holder 40, and which thus are verified to be present at the location of the collectible. Other users can be denied access. In some embodiments the grading organization may have a secondary web page prepared for those who are not verified to be present at the location of the collectible. Such secondary web page may have access to a different, perhaps less detailed, set of information about the collectible.

In still further embodiments the grading organization's system 202 can be configured to only allow access to certain collectible content upon satisfaction of additional or other criteria, such as a user specifically registering with the system and providing identification, contact information, and/or other information as may be desired or requested.

Methods of using and of making the disclosed holders and components thereof are within the scope of the present invention.

Although inventive subject matter has been disclosed in the context of certain preferred or illustrated embodiments and examples, it will be understood by those skilled in the art that the inventive subject matter extends beyond the specifically disclosed embodiments to other alternative embodiments and/or uses of the invention and obvious modifications and equivalents thereof. In addition, while a number of variations of the disclosed embodiments have been shown and described in detail, other modifications, which are within the scope of the inventive subject matter, will be readily apparent to those of skill in the art based upon this disclosure. It is also contemplated that various combinations or subcombinations of the specific features and aspects of the disclosed embodiments may be made and still fall within the scope of the inventive subject matter. For example, embodiments as discussed in FIGS. 1-27 could be modified to incorporate the extensions between adjacent receiver walls depicted in FIG. 28; embodiments as discussed in FIGS. 1-9 could be modified to include a contiguous groove as in embodiments as discussed in FIGS. 21-27, or a discontiguous groove as in embodiments as discussed in FIGS. 10-20; and/or the contiguous lock wall depicted in embodiments of FIGS. 10-27 can be replaced with discontiguous lock walls as in the embodiments discussed in connection with FIGS. 1-9. Accordingly, it should be understood that various features and aspects of the disclosed embodiments can be combined with or substituted for one another in order to form varying modes of the disclosed inventive subject matter. Thus, it is intended that the scope of the inventive subject matter herein disclosed should not be limited by the particular disclosed embodiments described above, but should be determined only by a fair reading of the claims that follow.

What is claimed is:

1. A holder for storing a collectible, comprising:

a first housing having a first wall;

a second housing having a second wall;

the first housing and the second housing being configured so that the first housing can be assembled with the second housing, and an enclosed space is defined within the assembled first and second housings, the enclosed space defined between the first wall, the second wall, and an outer wall extending between the first wall and the second wall;

a collectible receiving structure disposed within the enclosed space and spaced from the outer wall, the collectible receiving structure defining a collectible receiving space sized and configured to retain the collectible therewithin; and a locking structure disposed within the enclosed space, the locking structure comprising a first locking member formed with the first housing and a second locking member formed with the second housing;

wherein the locking structure is configured so that before the first housing is assembled with the second housing the first locking member is movable relative to the second locking member, and when the first housing becomes fully assembled with the second housing the locking structure moves to a triggered configuration in which the first locking member and the second locking member are engaged with one another;

wherein one of the first and second locking members comprises a catch and the other of the first and second locking members comprises a slot configured to receive the catch; and wherein when the locking structure is in the triggered configuration, the first housing is blocked from being disassembled from the second housing.

2. The holder of claim 1, wherein the outer wall extends from the first wall of the first housing, and a lock wall extends from the second wall of the second housing, and the second locking member is disposed on the lock wall.

3. The holder of claim 2, wherein when the first and second housings are assembled, access to the locking structure from outside the holder is blocked by one or more of the first wall, second wall, and outer wall.

4. The holder of claim 3, wherein the first locking member is formed on an inner surface of the outer wall.

5. The holder of claim 4, wherein the first locking member comprises the catch; and the second locking member comprises the slot.

6. The holder of claim 5, wherein the catch and the slot are both elongated.

7. The holder of claim 6, comprising a plurality of spaced-apart catches and corresponding spaced apart grooves.

8. The holder of claim 2, wherein the lock wall is spaced from an outer edge of the second wall, and a second wall edge surface is defined between the lock wall and the second wall outer edge, and wherein when the first and second housings are assembled, an outer wall tip engages the second wall edge surface.

9. The holder of claim 8, wherein an elongated groove is formed in the second wall outer edge, and an elongated tongue extends from the outer wall tip, the tongue and groove sized and located so that the tongue is received within the groove when the first and second housings are assembled.

10. The holder of claim 9, wherein the groove has a key structure formed therewithin, and the tongue has a key cavity shaped to complement the key structure so that the tongue registers with the groove.

11. The holder of claim 2, wherein a first portion of the lock wall is more resistant to flexing about a base of the lock wall than is a second portion of the lock wall.

12. The holder of claim 1, wherein the collectible receiving space is shaped so as to have a plurality of corners, wherein the collectible receiving structure comprises a plurality of receiver walls, each receiver wall of the plurality of receiver walls extending from a respective base to a respective tip, the base connected to one of the first wall and second wall, each of the plurality of receiver walls being elongated from a first end to a second end, and wherein a first one of the plurality of receiver walls is positioned so that its first end is spaced from a first corner of the plurality of corners of the collectible receiving space and its second end is spaced from a second corner of the plurality of corners of the collectible receiving space.

13. The holder of claim 12, additionally comprising a raised platform extending from one of the first wall and second wall, wherein the raised platform has an outer edge, and wherein the raised platform is sized and positioned so that when the first and second housings are assembled, the raised platform is within the collectible receiving space and the outer edge is spaced from adjacent ones of the plurality of receiver walls.

14. The holder of claim 12, wherein a channel is formed in one of the first wall and second wall, and wherein the channel is sized and configured so that when the first and second housings are assembled the channel is aligned with the plurality of receiver walls attached to the other of the first wall and second wall, and wherein the receiver walls are sized so that, when the first and second housings are assembled, the tips of the receiver walls extend into the channel.

15. The holder of claim 1, wherein the collectible receiving structure disposed within the enclosed space is sized and shaped to accommodate a stack of banknotes.

16. The holder of claim 15, wherein the collectible receiving space has two sets of two parallel receiver walls that are sized and shaped to accommodate the stack of banknotes.

17. The holder of claim 16, wherein the two sets of two parallel receiver walls define a generally rectangular shaped region, and wherein four corners of the generally rectangular shaped region are spaced from four corners of the stack of banknotes.

18. A method of securing a collectible, comprising:

placing the collectible in a collectible receiving space defined by one or more receiver walls of a first housing, the first housing having a first wall, the one or more receiver walls extending from the first wall;

placing a label indicia in a label space defined in the first housing and spaced from the collectible receiving space;

assembling the first housing with a second housing to form a collectible holder, comprising advancing the second housing over the first housing until a first locking structure on the first housing engages a second locking structure on the second housing;

wherein when the first locking structure is engaged with the second structure the first housing is prevented from being removed from the second housing; and wherein one of the first and second locking members comprises a catch and the other of the first and second locking members comprises a slot configured to receive the catch.

19. The method of claim 18, wherein the first locking structure is spaced outwardly from the collectible receiving space.

20. The method of claim 19, wherein the first wall, the second wall, and an outer wall extending between the first wall and second wall block access to the engaged first and second locking structures from outside the collectible holder.

21. The method of claim 20, additionally comprising advancing a tongue of the outer wall into a groove formed in one of the first wall and second wall while assembling the first housing with the second housing.

22. The method of claim 21, additionally comprising ultrasonically welding at least portion of the tongue to corresponding portions of the groove.

23. A holder for storing a collectible, comprising:

a first housing having a first wall and an outer wall, and wherein the outer wall comprises an outer wall exterior surface and an outer wall interior surface;

a second housing having a second wall;

the first housing connectable to the second housing so that the first wall, the second wall, and the outer wall define an enclosed space;

a collectible receiving structure comprising a plurality of receiver walls disposed within the enclosed space and spaced from the outer wall, the collectible receiving structure defining a collectible receiving space sized and configured to retain the collectible therewithin; and a locking structure disposed within the enclosed space, the locking structure comprising a catch and a lock receiver that are configured so that before the first housing is assembled with the second housing, the locking structure moves to a triggered configuration in which the catch and the lock receiver are irreversibly engaged with one another.

24. The holder of claim 23, wherein a lock wall extends from the second wall of the second housing, and the catch is disposed on the lock wall.

25. The holder of claim 24, wherein the lock wall comprises a plurality of spaced apart locking wall portions.

26. The holder of claim 24, wherein the lock wall comprises a plurality of locking wall portions that connect to one another.

27. The holder of claim 24, wherein the lock wall has a height measure from a base at the second wall to a tip, and wherein the outer wall has a height measure from a base at the first wall to a tip, and wherein the height of the lock wall is less than a height of the outer wall.

28. The holder of claim 23, wherein when the first and second housings are assembled, access to the locking structure from outside the holder is blocked by one or more of the first wall, the second wall and the outer wall.

29. The holder of claim 23, wherein the lock receiver is on the outer wall interior surface.

30. The holder of claim 23, wherein the plurality of receiver walls extend from the second wall.

31. The holder of claim 30, wherein the plurality of receiver walls are connected by a curved wall.

32. The holder of claim 23, wherein the second housing comprises a trough.

33. The holder of claim 32, wherein a label space is located between the first housing and the second housing at the trough.

* * * * *